US008393621B2

(12) United States Patent
Hayashi et al.

(10) Patent No.: US 8,393,621 B2
(45) Date of Patent: Mar. 12, 2013

(54) SHEET STACKING APPARATUS AND IMAGE FORMING APPARATUS

(75) Inventors: Kenichi Hayashi, Abiko (JP); Yusuke Obuchi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/565,479

(22) Filed: Aug. 2, 2012

(65) Prior Publication Data

US 2012/0292850 A1 Nov. 22, 2012

Related U.S. Application Data

(63) Continuation of application No. 11/849,983, filed on Sep. 4, 2007, now Pat. No. 8,282,098.

(30) Foreign Application Priority Data

Sep. 6, 2006 (JP) ..... 2006-242078
Aug. 21, 2007 (JP) ..... 2007-214884

(51) Int. Cl.
*B65H 39/10* (2006.01)

(52) U.S. Cl. ..... 271/289; 271/287; 271/290; 271/298

(58) Field of Classification Search ..... 271/287, 271/288, 289, 290, 298
See application file for complete search history.

(56) References Cited

U.S. PATENT DOCUMENTS 5,356,131 A * 10/1994 Mauro ..... 271/288
5,371,573 A * 12/1994 Kagaya et al. ..... 399/18
5,640,908 A * 6/1997 Schaede ..... 101/484
6,234,474 B1 * 5/2001 Horii et al. ..... 271/288
7,597,324 B2 * 10/2009 Obuchi et al. ..... 271/288
7,845,633 B2 * 12/2010 Ichimura ..... 271/176
2005/0220475 A1 * 10/2005 Kasahara ..... 399/82
2008/0012217 A1 * 1/2008 Bottger et al. ..... 271/279
2009/0309300 A1 * 12/2009 Obuchi et al. ..... 271/288
2010/0320679 A1 * 12/2010 Miyake et al. ..... 271/298
2012/0013069 A1 * 1/2012 Obuchi et al. ..... 271/288

FOREIGN PATENT DOCUMENTS

JP 2588807 * 11/1998

* cited by examiner

*Primary Examiner* — Kaitlin Joerger
*Assistant Examiner* — Ernesto Suarez
(74) *Attorney, Agent, or Firm* — Canon USA, Inc., IP Division

(57) ABSTRACT

A sheet stacking apparatus includes a conveyance portion, a first sheet stacking portion, a second sheet stacking portion, and a controller. The conveyance portion includes a holding portion that moves while holding a downstream end of a sheet. The first and second sheet stacking portions include stacking surfaces and the second sheet stacking portion is arranged downstream of the first sheet stacking portion. The controller controls to cause the holding portion to convey to the second sheet stacking portion. When the sheet to be stacked on the second sheet stacking portion passes over the first sheet stacking portion, an upstream end of the sheet in the sheet conveying direction is guided along the first sheet stacking portion stacking surface, on which a sheet is not stacked, while the downstream end of the sheet is held by the holding portion.

19 Claims, 18 Drawing Sheets

SHEET STACKING APPARATUS AND IMAGE FORMING APPARATUS

CROSS REFERENCE TO RELATED APPLICATIONS

The present application is a continuation of U.S. patent application Ser. No. 11/849,983, filed on Sep. 4, 2007, which claims priority from Japanese Patent Application Nos. 2006-242078, filed Sep. 6, 2006, and 2007-214884, filed Aug. 21, 2007, all of which are hereby incorporated by reference herein in their entirety.

BACKGROUND OF THE INVENTION

1. Field of the Invention

The present invention relates to a sheet stacking apparatus and an image forming apparatus configured to stack a large number of sheets on a sheet stacking portion. More particularly, the present invention relates to a sheet stacking apparatus and an image forming apparatus configured to stack sheets discharged at high speed from a main body of the image forming apparatus, with precise alignment.

2. Description of the Related Art

In recent years, thanks to technological advances, an image forming apparatus has become capable of forming images at higher speed. Together with the increase in image forming speed, sheet discharging speed from the image forming apparatus has also increased. As a result, demand for a high-volume sheet stacking apparatus with precise alignment capability is increasing.

Japanese Patent Application Laid-Open No. 2006-124052, for example, discusses a sheet stacking apparatus which includes a pressing member that presses a sheet against a sheet rack so that the sheet can be discharged to the sheet rack more speedily.

FIG. 18 illustrates a configuration of a conventional sheet stacking apparatus which enables high-volume output. The sheet stacking apparatus is attached to a conveying belt 508 that rotates clockwise and includes a gripper 503. The gripper 503 rotates together with the conveying belt 508 to convey a sheet while holding a leading edge of the sheet. Further, the sheet stacking apparatus includes a leading edge pressing member 506 and a trailing edge pressing member 507 configured to press down a leading edge and a trailing edge of a sheet.

In the sheet stacking apparatus having such a configuration, a sheet discharged from an image forming apparatus (not shown) is received by an inlet roller 501 and then a leading edge of the sheet is turned over to the gripper 503 by a conveyance roller 502. Then, the conveying belt 508 rotates, and the gripper 503 moves together with the conveying belt 508 while holding the leading edge of the sheet. In this way, the sheet is conveyed along the upper portion of the sheet stacking portion 505.

When the leading edge of the sheet abuts a leading edge stopper 504, the gripper 503 releases the sheet so that the sheet is discharged onto the sheet stacking portion 505. In this manner, a predetermined number of sheets are stacked. Every time a sheet is stacked, an alignment member (not shown) performs a jogging process in a direction perpendicular to the sheet conveying direction (hereinafter referred to as width direction) so that alignment of the sheets is improved.

When sheets are stacked at high speed, the possibility of a sheet jam, occurring when a sheet interferes with a trailing edge of a preceding sheet stacked on the sheet stacking portion 505, is increased. Therefore, during sheet stacking, the leading edge pressing member 506 and the trailing edge pressing member 507 press down a leading edge and a trailing edge of a sheet so that the sheet is quickly discharged to the sheet stacking portion 505.

In other words, when sheets are stacked at high speed, the leading edge pressing member 506 and the trailing edge pressing member 507 press a leading edge and a trailing edge of a sheet against the sheet stacking portion 505 at the time the sheet is discharged to the sheet stacking portion 505 so that the sheet is out of the way of the next sheet.

However, in such a conventional sheet stacking apparatus and an image forming apparatus having such an sheet stacking apparatus, a size of the sheet stacking portion 505 is determined according to a maximum size of a sheet to be stacked. Further, only a single stack of sheets is allowed in the sheet stacking portion 505. Accordingly, even if a sheet which is half the size of the maximum-size sheet is stacked, the number of sheets that can be stacked is the same as the number of maximum-size sheets. Accordingly, an unused space X shown in FIG. 18 appears in the sheet stacking portion 505.

In other words, in the conventional sheet stacking apparatus, even when a sheet-stackable space exists in the sheet stacking portion 505, the space is not used for the purpose of stacking sheets. Therefore, there has been a problem that a sheet-stackable space in the sheet stacking portion 505 is not effectively used.

In order to solve this problem, Japanese Patent Application Laid-Open No. 9-255213, for example, discusses an apparatus which is capable of stacking two stacks of sheets. This apparatus enables stacking of two stacks of half-size sheets (for example, A4 landscape) on a sheet stacking portion which is configured to stack a maximum length of a sheet (for example, A3 portrait).

However, since this apparatus utilizes space by stacking two stacks of half-size sheets on a sheet stacking portion by changing sheet discharging positions, no adequate margin of space is left on the sheet stacking portion. Thus, when a sheet is discharged beyond its stacking space, it affects its adjacent stacking space. In particular, when a sheet is stacked starting from an upstream stacking space, the sheet tends to go beyond its stacking space to the downstream stacking space by a discharging force and a case of misalignment can increase. Further, it is possible that a stack of sheets leans on the other stack, or a stack pushes the other stack in the sheet discharging direction. Consequently, stacking capacity of the apparatus decreases.

SUMMARY OF THE INVENTION

The present invention is directed to a sheet stacking apparatus capable of stacking a large number of sheets on a sheet stacking portion with improved alignment and an image forming apparatus including such a sheet stacking apparatus.

According to an aspect of the present invention, a sheet stacking apparatus includes a conveyance portion configured to convey a sheet, including a holding portion configured to move in a sheet conveying direction while holding a downstream end of the sheet in the sheet conveying direction, a first sheet stacking portion, having a first stacking surface which moves down depending on increase of stacked sheets thereon, configured to stack a sheet conveyed by the conveyance portion, a second sheet stacking portion, having a second stacking surface which moves down depending on increase of stacked sheets thereon, configured to stack a sheet conveyed by the conveyance portion, and to be arranged downstream of the first sheet stacking portion in the sheet conveying direction of the conveyance portion, and a controller configured to determine one of the first and second sheet stacking portions as a destination of the sheet, based on sheet information of the sheet to be stacked, the controller controlling movement of the holding portion so that the holding portion firstly conveys, to the second sheet stacking portion, a sheet to be stacked, and then conveys, to the first sheet stacking portion, a sheet to be stacked, when a total number of sheets to be stacked for a given job, as the sheet information, exceeds a number of sheets which can be stacked on one of the first and second sheet stacking portions, wherein when the sheet to be stacked on the second sheet stacking portion passes over the first sheet stacking portion, an upstream end of the sheet in the sheet conveying direction is guided along stacking surface, on which a sheet is not stacked, of the first sheet stacking portion while the downstream end of the sheet is held by the holding portion.

According to another aspect of the present invention, an image forming apparatus includes an image forming unit configured to form an image on a sheet, a sheet stacking apparatus, configured to stack an image-formed sheet, and a controller configured to control the sheet stacking apparatus based on sheet information of the sheet to be stacked, wherein the sheet stacking apparatus includes: a conveyance portion configured to convey a sheet, including a holding portion configured to move in a sheet conveying direction while holding a downstream end of the sheet in the sheet conveying direction, a first sheet stacking portion, having a first stacking surface which moves down depending on increase of stacked sheets thereon, configured to stack a sheet conveyed by the conveyance portion, and a second sheet stacking portion, having a second stacking surface which moves down depending on increase of stacked sheets thereon, configured to stack a sheet conveyed by the conveyance portion, and to be arranged downstream of the first sheet stacking portion in the sheet conveying direction of the conveyance portion, wherein the controller controls movement of the holding portion so that the holding portion firstly conveys, to the second sheet stacking portion, a sheet to be stacked, and then conveys, to the first sheet stacking portion, a sheet to be stacked, when a total number of sheets to be stacked for a given job, as the sheet information, exceeds a number of sheets which can be stacked on one of the first and second sheet stacking portions, and wherein when the sheet to be stacked on the second sheet stacking portion passes over the first sheet stacking portion, an upstream end of the sheet in the sheet conveying direction is guided along the first stacking surface, on which a sheet is not stacked, of the first sheet stacking portion while the downstream end of the sheet is held by the holding portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
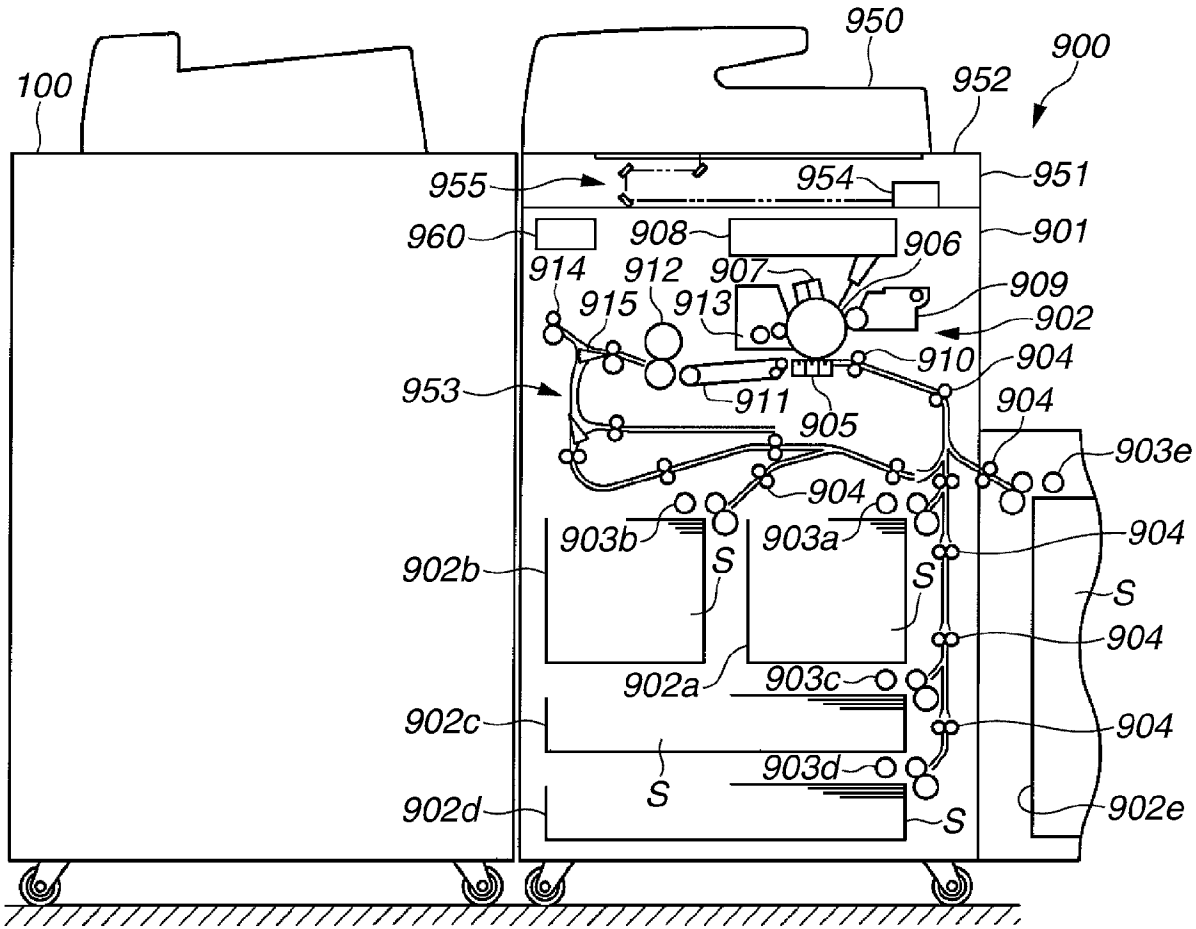
FIG. 1 illustrates a configuration of an image forming apparatus including a sheet stacking apparatus according to an exemplary embodiment of the present invention.

FIG. 1 illustrates a configuration of an image forming apparatus including a sheet stacking apparatus according to an exemplary embodiment of the present invention.

FIG. 1 illustrates an image forming apparatus 900 having an image forming apparatus main body 901. The image forming apparatus main body 901 is provided with an image scanning apparatus 951 having a scanner unit 955 and an image sensor 954, an image forming unit 902 configured to form an image on a sheet, a double-side printing device 953, and a platen glass 952. Further, a document feeding apparatus 950 configured to feed a document to the platen glass 952 is provided on the upper part of the image forming apparatus main body 901.

The image forming unit 902 includes a cylindrical photosensitive drum 906, a charging unit 907, a developer 909, and a cleaning apparatus 913. Also, a fixing apparatus 912 and a discharge roller pair 914 are provided downstream of the image forming unit 902. A stacker 100 (i.e., a sheet stacking apparatus) is connected to the image forming apparatus main body 901. The stacker 100 is configured to stack image-formed sheets discharged from the image forming apparatus main body 901. A control unit 960 mounted on the image forming apparatus main body 901 controls the image forming apparatus main body 901 and the stacker 100.

Next, an image forming operation of the image forming apparatus main body 901 having the above configuration will be described.

When the control unit 960 outputs an image forming signal, the document feeding apparatus 950 places a document on the platen glass 952. Then, the image scanning apparatus 951 scans an image of the document, and the scanned digital data is input to an exposure unit 908. The exposure unit 908 irradiates the photosensitive drum 906 with a light corresponding to the digital data.

At this time, the surface of the photosensitive drum 906 is charged evenly by the charging unit 907. When a laser beam from the exposure unit 908 scans the photosensitive drum 906, an electrostatic latent image is formed on the surface of the photosensitive drum 906. The developer 909 develops the electrostatic latent image and a toner image is formed on the surface of the photosensitive drum 906.

On the other hand, when the control unit 960 outputs a sheet feed signal, a sheet S set on one of cassettes 902*a* through 902*e* is conveyed to a registration roller 910 by feeding rollers 903*a* through 903*e* and a conveyance roller pair 904.

Next, the sheet S is conveyed to a transfer unit including a charging unit 905 at a timing at which the leading edge of the sheet synchronizes with the toner image on the photosensitive drum 906 owing to the registration roller 910. At the transfer unit, a transfer bias is applied to the sheet S by the charging unit 905, and a toner image on the photosensitive drum 906 is transferred to the sheet.

Subsequently, the sheet S with the transferred toner image is conveyed to the fixing apparatus 912 by a conveying belt 911. The toner image is thermally fixed while the sheet is sandwiched between and conveyed by the heating roller and the pressure roller of the fixing apparatus 912. At this time, undesired matters such as remaining toner which was not transferred to the sheet are scraped off by a blade of the cleaning apparatus 913 from the photosensitive drum 906. As a result, the surface of the photosensitive drum 906 is cleaned and ready for the next image forming.

The image-fixed sheet is conveyed to the stacker 100 by a discharge roller 914 or conveyed to the double-side printing device 953 where the sheet is reversed by a switching member 915 to form an image again.

Figure 2:
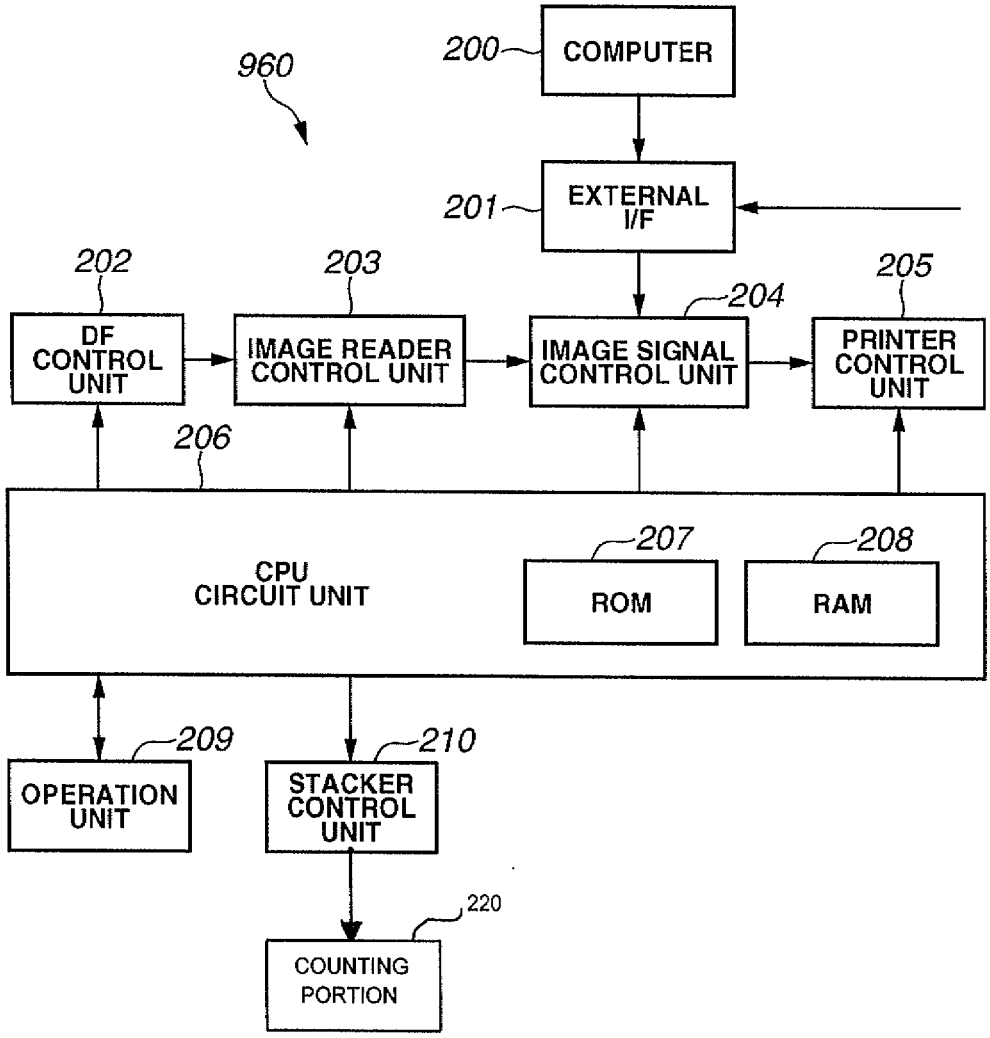
FIG. 2 is a control block diagram of a control unit provided in the image forming apparatus according to an exemplary embodiment of the present invention.

FIG. 2 is a block diagram illustrating a configuration of the control unit 960. The control unit 960 has a central processing unit (CPU) circuit unit 206. The CPU circuit unit 206 includes a CPU (not shown), a read only memory (ROM) 207, and a random access memory (RAM) 208. Further, a document feeder (DF) control unit 202, an operation unit 209, an image reader control unit 203, an image signal control unit 204, a printer control unit 205, and a stacker control unit 210 are controlled overall according to a control program stored in the ROM 207. The RAM 208 temporarily stores control data and also provides a working area for calculation processing required for the control.

The DF control unit 202 performs control to drive the document feeding apparatus 950 based on an instruction from the CPU circuit unit 206. The image reader control unit 203 performs control to drive the scanner unit 955 and the image sensor 954 arranged on the image scanning apparatus 951, and transfers an analog image signal output from the image sensor 954 to the image signal control unit 204.

The image signal control unit 204 converts an analog image signal sent from the image sensor 954 to a digital signal, processes the digital signal, converts the processed digital signal to a video signal, and outputs the video signal to the printer control unit 205.

The image signal control unit 204 also performs various types of processing to the digital signal input from a computer 200 or from an external apparatus through an external I/F 201, and converts the digital image signal to a video signal which is then output to the printer control unit 205. The CPU circuit unit 206 controls the processing operation performed by the image signal control unit 204.

The printer control unit 205 drives the exposure unit 908 through an exposure control unit (not shown) based on the input video signal. The operation unit 209 is provided in the image forming apparatus main body 901 and includes a plurality of keys configured to set various types of functions for forming an image and a display unit for displaying a setting state. Further, the operation unit 209 outputs key signals corresponding to each key operation to the CPU circuit unit 206 and also displays information corresponding to signals sent from the CPU circuit unit 206.

The stacker control unit 210 serving as a controller is mounted on the stacker 100 and performs control to drive the entire stacker by exchanging information with the CPU circuit unit 206 of the image forming apparatus main body 901. The control of the stacker control unit 210 will be described later. The stacker control unit 210 and the CPU circuit unit 206 can also be integrally mounted on the image forming apparatus main body 901 as a controller so that the stacker 100 is controlled from the image forming apparatus main body 901.

Figure 3:
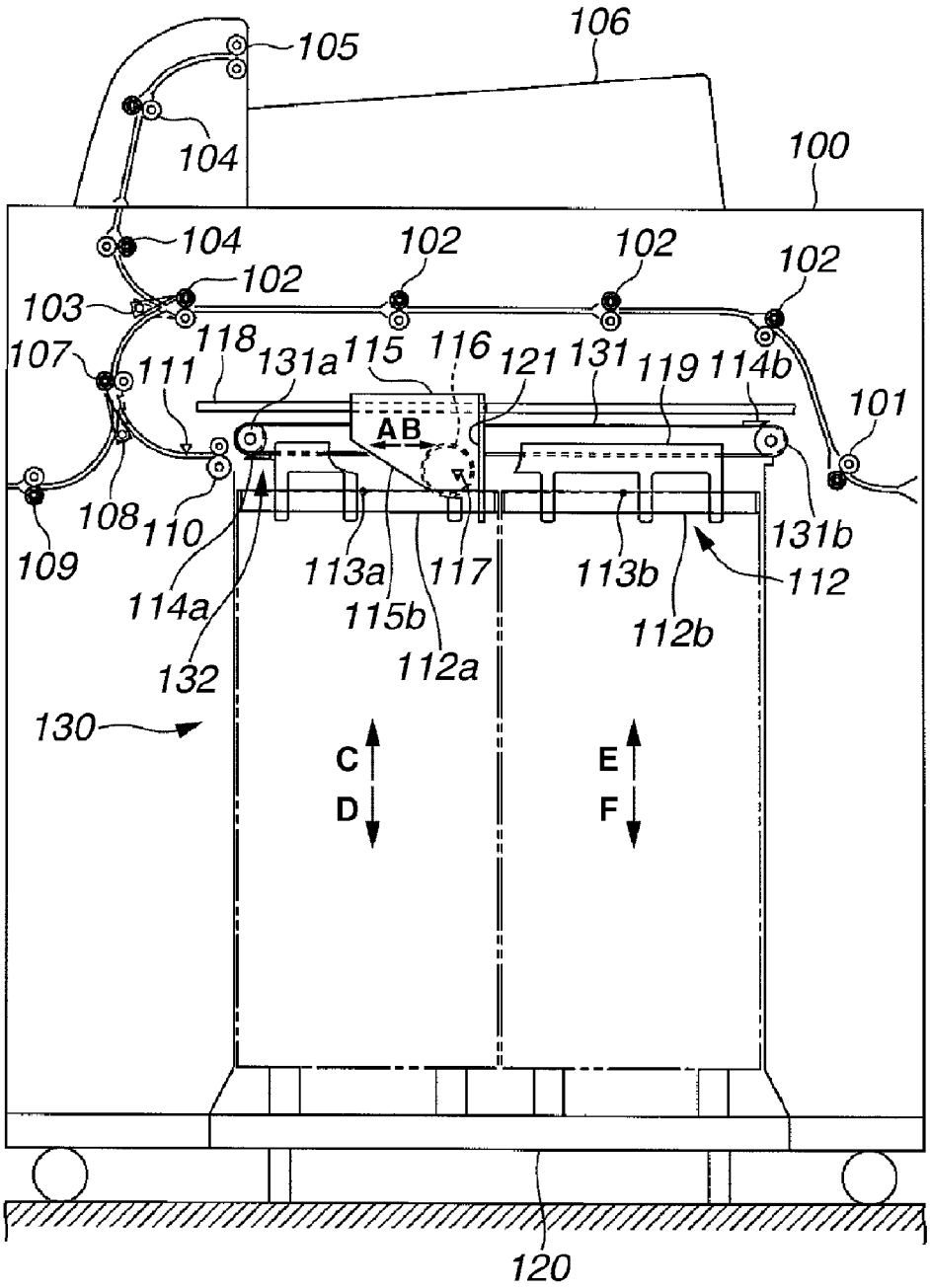
FIG. 3 illustrates a stacker connected to a main body of the image forming apparatus according to an exemplary embodiment of the present invention.

FIG. 3 illustrates a configuration of the stacker 100. The stacker 100 has a top tray 106 configured to stack sheets discharged from the image forming apparatus main body 901 on its top face. Further, the stacker 100 has a stacking portion 130 including a sheet stacking portion 112. The sheet stacking portion 112 includes a plurality of sheet stacking portions configured to stack sheets and arranged in a row. A first stacker tray 112*a* and a second stacker tray 112*b* (i.e., sheet stacking portions) are arranged one after the other in the sheet discharging direction. The stacker 100 also includes a switching member 103 which guides the sheet S conveyed to the stacker to the top tray 106 or to the stack portion 130.

Furthermore, a solenoid (not shown) drives an outlet switching member 108 illustrated in FIG. 3 so that the switching member 108 moves to a position shown by a broken line when the destination of the sheet is a sheet processing apparatus at a downstream side (not shown).

Figure 4:
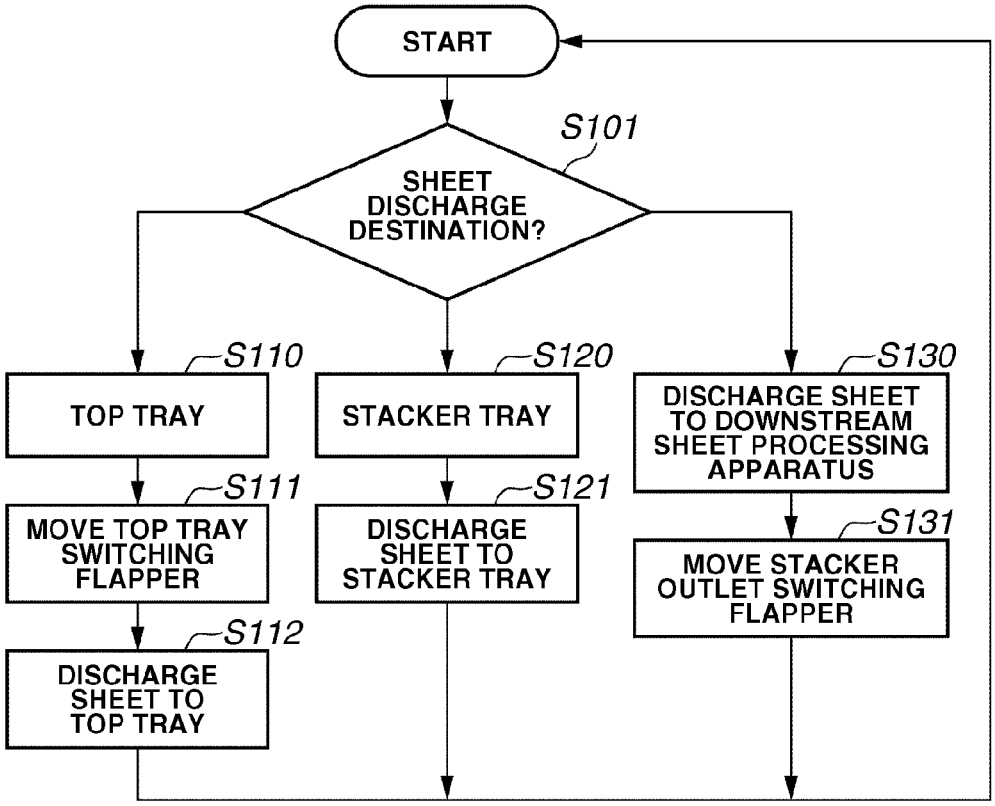
FIG. 4 is a flowchart of a basic control of the stacker according to an exemplary embodiment of the present invention.

Next, a basic control of the stacker 100 performed by the stacker control unit 210 will be described referring to the flowchart illustrated in FIG. 4.

The sheet S discharged from the image forming apparatus main body 901 is conveyed into the stacker 100 by an inlet roller pair 101 and then conveyed to the switching member 103 by conveyance roller pairs 102.

Before the sheet is conveyed, the CPU circuit unit 206 of the control unit 960 in the image forming apparatus main body 901 sends sheet information including sheet size, sheet type and destination of the sheet to the stacker control unit 210 serving as a controller.

The stacker control unit 210 determines a destination of the sheet transferred from the control unit 960 (step S101). If the destination of the sheet is the top tray 106 (step S110), the stacker control unit 210 controls the switching member 103 driven by a solenoid (not shown)(step S111) so that the switching member 103 changes its position to a position shown in a broken line in FIG. 3. The sheet S is conveyed by a conveyance roller pair 104 and then, discharged onto the top tray 106 by a discharge roller 105 (step S112) and stacked.

If the destination of the sheet is the stacker tray 112*a* or 112*b* (step S120), the sheet is conveyed to the stacker tray 112*a* or 112*b* to be stacked by a conveyance roller pair 107 and a discharge roller 110 which constitutes the sheet discharging portion (step S121).

If the destination of the sheet is a sheet processing apparatus at a downstream side (step S130), a solenoid (not shown) drives an outlet switching member 108 (step S131) so that the switching member 108 changes its position to a position shown in a broken line in FIG. 3. The sheet conveyed by the conveyance roller pair 102 is conveyed by the conveyance roller pair 107, led by a delivery roller pair 109 and conveyed to the sheet processing apparatus at the downstream side.

As shown in FIG. 3, the first and the second stacker trays 112*a* and 112*b* of the stack portion 130 are arranged so that they can be separately moved up and down in the directions shown in the arrows C and D and arrows E and F by a driving device (not shown). A length of the first and the second stacker trays 112*a* and 112*b* in the sheet conveying direction is appropriate for stacking an ordinary half-size sheet (for example, A4 size if large size is A3).

A guiding unit 115 guides a sheet conveyed from a sheet conveyance portion 132 into the stacker tray 112*a* or 112*b*. The guiding unit 115 includes a knurled belt 116 which is rotated counterclockwise by a driving device (not shown) to draw in the sheet toward an upper part of the stacker tray, and a leading edge stopper 121 (abutting unit) configured to determine a position of the sheet in the sheet conveying direction.

The sheet is drawn by the knurled belt 116 until it abuts against the leading edge stopper 121. The guiding unit 115 is mounted on a slide shaft 118 which is movable in directions shown in arrows A and B. Also, the guiding unit 115 can be moved to a position corresponding to the sheet size (i.e., sheet length in the sheet conveying direction) by a driving device (not shown).

Further, the guiding unit 115 has a taper portion 115*b* which is used for guiding the sheet to the knurled belt 116.

A sheet surface detection sensor 117 is configured to keep a constant distance between the guiding unit 115 and the top surface of the sheet stack. According to the present exemplary embodiment, a position of the top surface of the sheet stack is set below the discharge roller 110 so that even when the top sheet has an upward curl, the leading edge of the next sheet does not stick in the discharging roller 110.

Home position sensors 113*a* and 113*b* detect a home position of the first stacker tray 112*a* and the second stacker tray 112*b* at an initial operation but function as a sheet surface detection sensor for the first stacker tray 112*a* and the second stacker tray 112*b* during stacking operation.

In FIG. 3, the first and the second stacker trays 112*a* and 112*b* are positioned at their home positions as detected by the home position sensors 113*a* and 113*b*. The home positions are where the trays stack sheets. When the first stacker tray 112*a* and the second stacker tray 112*b* are at their home positions, their sheet stacking surfaces are level.

A drive belt 131 is wound around a drive roller 131*a* and a driven roller 131*b* and rotated counterclockwise by a driving device (not shown). Grippers 114*a* and 114*b* are attached to the drive belt 131 and pinch (hold) the leading edge of a sheet to convey the sheet. The grippers 114*a* and 114*b*, and the drive belt 131 constitute the sheet conveyance portion 132. The sheet conveyance portion 132 is arranged separate from the first stacker tray 112*a* and the second stacker tray 112*b*, and conveys a sheet along the first stacker tray 112*a* and the second stacker tray 112*b*.

The grippers 114*a* and 114*b* are attached to the drive belt 131 and urged in a clockwise direction by a torsion coil spring (not shown). A driving device (not shown) drives the grippers 114*a* and 114*b* so that the grippers 114*a* and 114*b* move to a position where they hold a sheet and a position where they release the sheet.

Further, a timing sensor 111 is arranged upstream of the discharge roller 110. The timing sensor 111 detects a timing of the sheet at which a leading edge of the sheet passes the timing sensor. An alignment plate 119 is also provided.

As described above, before the sheet is conveyed to the stacker 100, the CPU circuit unit 206 sends information about the sheet which is conveyed (e.g., size information) to the stacker control unit 210. Then, the stacker control unit 210 determines whether the sheet is to be stacked on the first stacker tray 112*a*, the second stacker tray 112*b*, or across the first stacker tray 112*a* and the second stacker tray 112*b*, according to the length of the sheet in the sheet conveying direction.

Next, control by the stacker control unit 210 regarding selection of a number of trays to be used, and a tray to be used corresponding to a sheet length in the sheet conveying direction will be described.

First, selection of a number of trays to be used and a tray to be used when the stacked sheet is a half-size sheet will be described. The half-size sheet can be stacked on the first stacker tray 112*a* or the second stacker tray 112*b*.

In this case, according to a sheet size and a job input through the operation unit 209, the CPU circuit unit 206 calculates a total number n of sheets which are to be stacked. The operation unit 209 is a sheet-size setting portion of the image forming apparatus main body 901. A number N of sheets which can be stacked on the first stacker tray 112*a* or the second stacker tray 112*b* is determined by a height of the image forming apparatus main body 901.

The stacker control unit 210 serving as a comparison portion compares the number N of sheets which can be stacked and the total number n of sheets which are to be stacked. If the number n is equal to or smaller than the number N, one of the first stacker tray 112*a* and the second stacker tray 112*b* is selected. For example, the first stacker tray 112*a* is selected since it is closer to the discharge roller 110 and requires less stacking time.

Next, an operation of stacking the sheets on the first stacker tray 112*a*, which is selected as described above, will be described.

Figure 5:
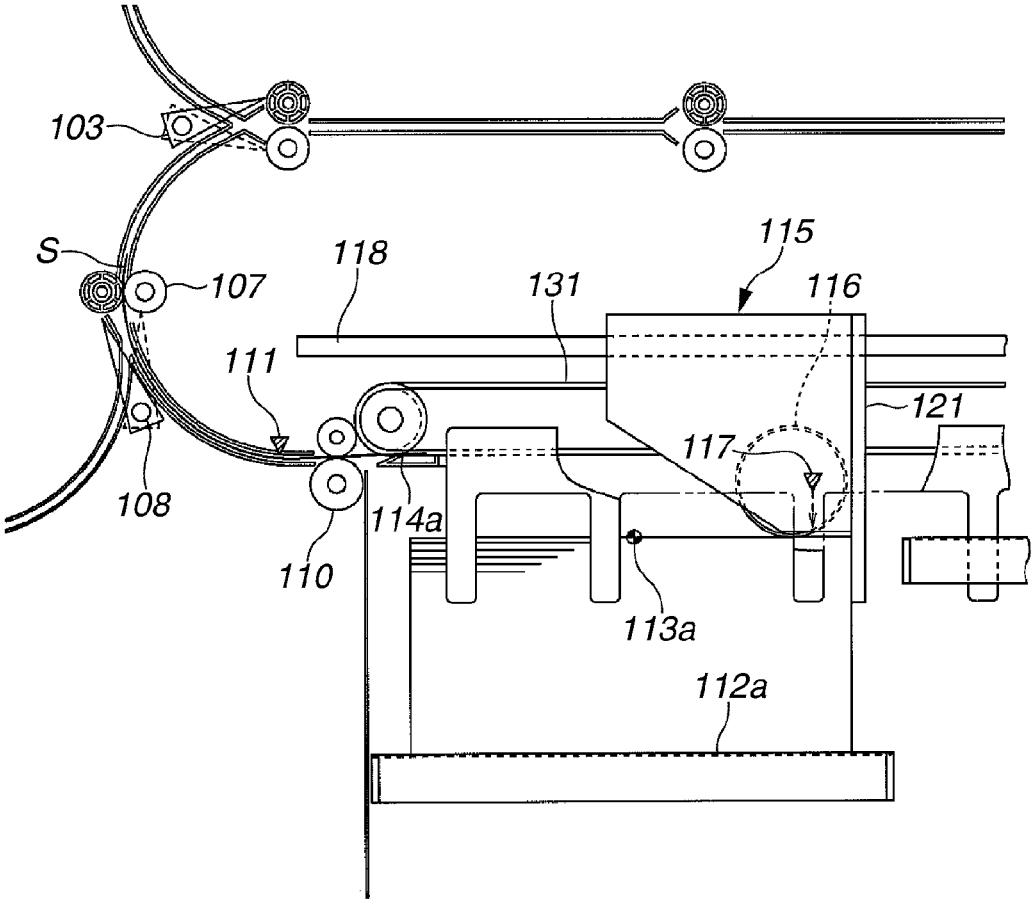
FIG. 5 is a first illustration for describing an operation of stacking a sheet on a first stacker tray arranged on the above described stacker according to an exemplary embodiment of the present invention.

In this case, when the sheet S sent from the image forming apparatus main body 901 is conveyed to the discharge roller 110 according to the sheet conveying operation shown in FIG. 5, the leading edge of the sheet is detected by the timing sensor 111. At this time, the guiding unit 115 waits at a downstream side of the first stacker tray 112*a* corresponding to the length of the sheet that is conveyed. Also, the first stacker tray 112*a* waits at its home position.

Next, according to the timing of passing of the leading edge which is detected by the timing sensor 111, a driving device (not shown) drives either the gripper 114*a* or the gripper 114*b* which is waiting. For example, the gripper 114*a* pinches (holds) the leading edge of the sheet.

Figure 6:
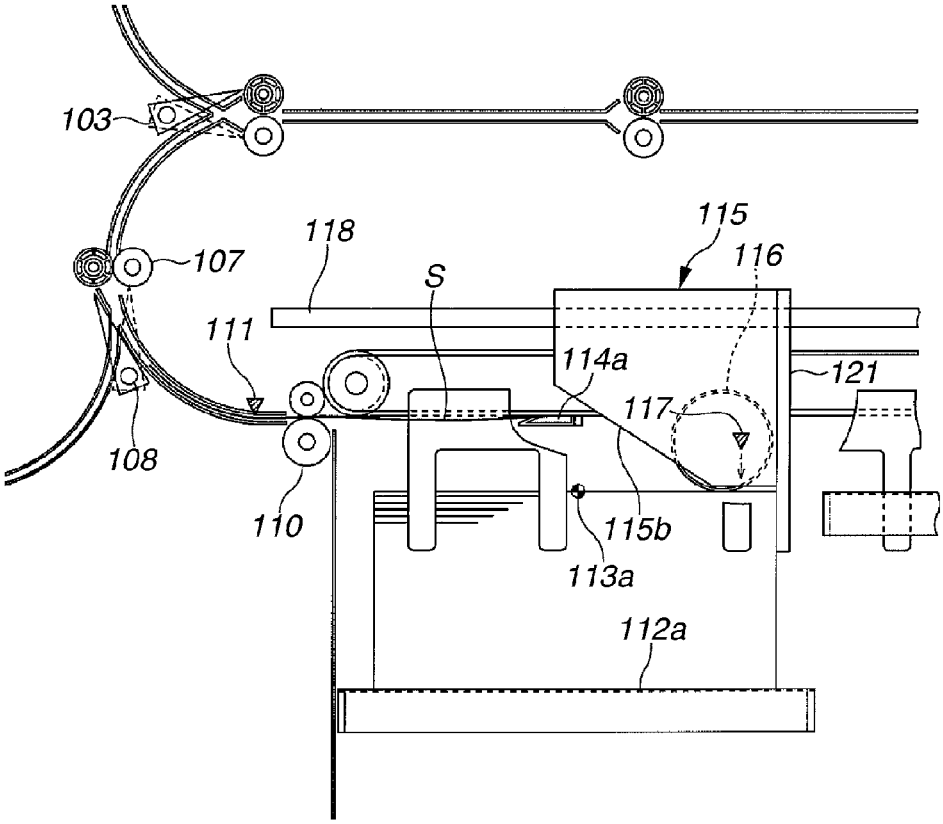
FIG. 6 is a second illustration for describing an operation of stacking a sheet on a first stacker tray according to an exemplary embodiment of the present invention.

Then, the drive belt 131 rotates counterclockwise, and the gripper 114*a* moves with the drive belt 131 holding the leading edge of the sheet. In this way, the sheet S is conveyed over and along the first stacker tray 112*a* as shown in FIG. 6.

Figure 7:
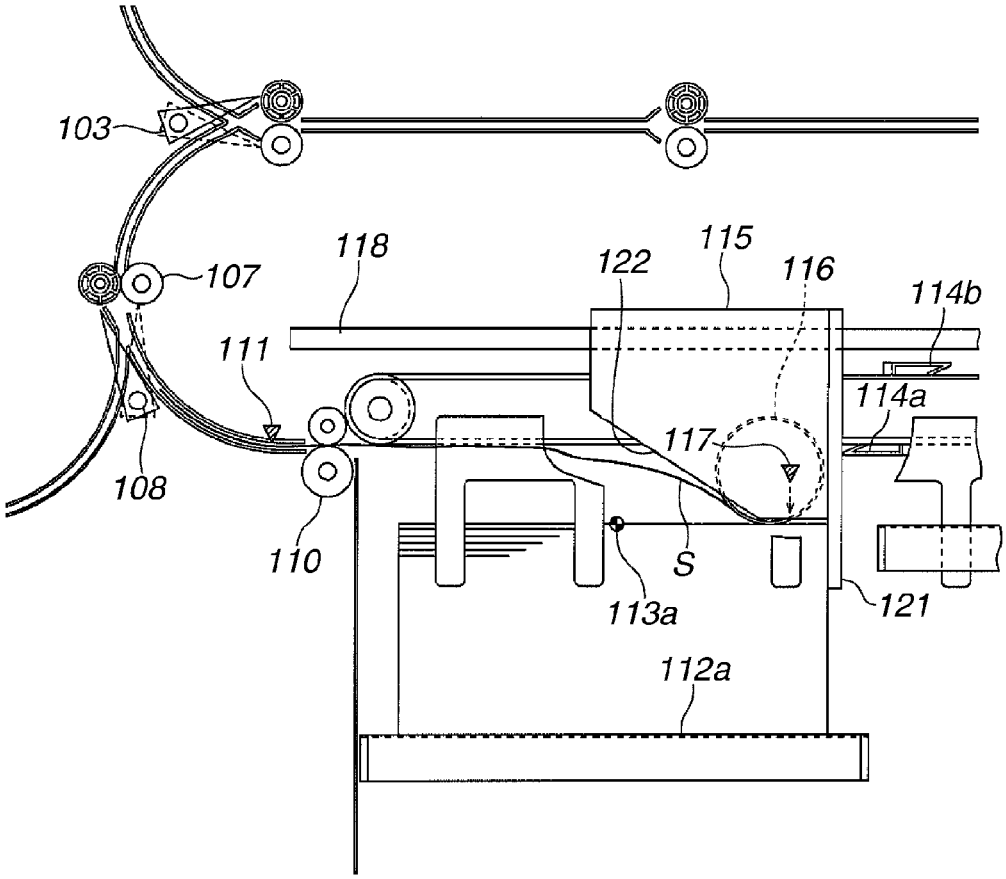
FIG. 7 is a third illustration for describing an operation of stacking a sheet on a first stacker tray according to an exemplary embodiment of the present invention.

When the gripper 114*a* passes by a taper portion 115*b* formed on the gripper side of the guiding unit 115, the gripper 114*a* is driven to release the sheet. Thus, the sheet S is conveyed while its leading edge is guided to the first stacker tray by the taper portion 115*b*, and then led to the knurled belt 116 as shown in FIG. 7. At this time, the sheet S abuts against the knurled belt 116 by an inertia force generated at the time the sheet is stacked.

Figure 8:
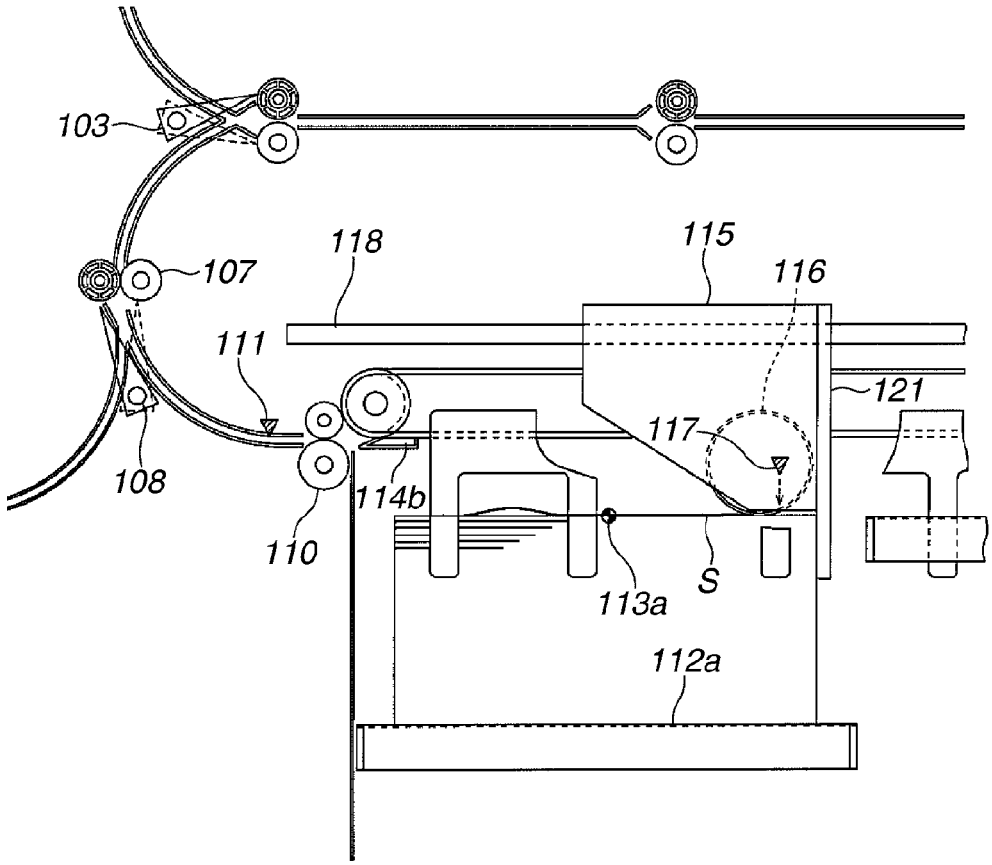
FIG. 8 is a fourth illustration for describing an operation of stacking a sheet on a first stacker tray according to an exemplary embodiment of the present invention.

After that, the sheet S is conveyed by the knurled belt 116 until its leading edge abuts against the stopper 121 as shown in FIG. 8. Then, the sheet S is stacked on the first stacker tray 112*a* with its leading edge aligned. After the sheet S is stacked in this manner, the alignment plate 119 aligns the sheets in the width direction. The alignment plate 119 withdraws by a predetermined amount after the sheets are aligned and waits until a new sheet is conveyed.

The stacker control unit 210 continuously monitors the top surface of the sheet stack on the first stacker tray 112*a* with the sheet surface detection sensor 117. If a distance between the guiding unit 115 and the top surface of the sheet stack becomes smaller than a predetermined value, the first stacker tray 112*a* is moved down by a predetermined amount by a stacker tray driving device (not shown) so that the distance between the guiding unit 115 and the top surface of the sheet stack remains constant.

By repeating this operation, sheets are successively stacked on the first stacker tray 112*a*. By repeating this operation an n number of times, n sheets are all stacked on the first stacker tray 112*a*.

Next, a case will be described where the total number n of sheets to be stacked is greater than the number N of sheets which can be stacked on the first stacker tray 112*a* or the second stacker tray 112*b*.

Figure 9:
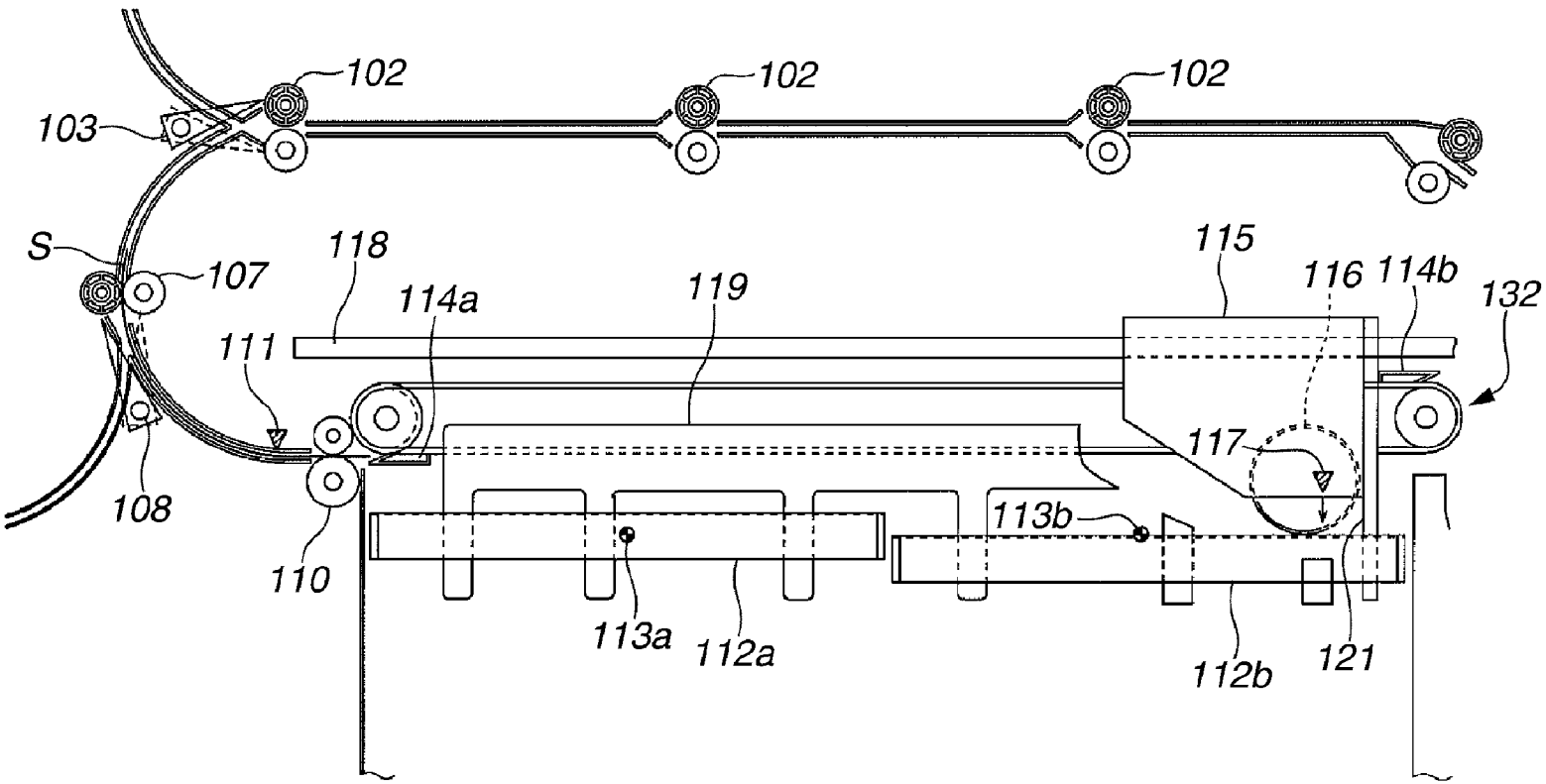
FIG. 9 is a first illustration for describing an operation of stacking a sheet when a total number of sheets to be stacked on the stacker is greater than the number of sheets stackable on the stacker tray according to an exemplary embodiment of the present invention.

In this case, the stacker control unit 210 performs control so that sheets are stacked on the second stacker tray 112*b* as well as the first stacker tray 112*a*. When the sheet S is conveyed onto the second stacker tray 112*b*, the sheet S goes over and along the first stacker tray 112*a*. Thus, if sheets are already stacked on the first stacker tray 112*a*, the sheets stacked on the first stacker tray 112*a* can be misaligned. Therefore, the sheet S is stacked on the second stacker tray 112*b* located downstream of the first stacker tray 112*a* so that the alignment of the sheets stacked on the first stacker tray 112*a* is not disturbed. Accordingly, before the sheet S is conveyed, the guiding unit 115 moves to the downstream side of the second stacker tray 112*b* according to the length of the conveyed sheet in the conveying direction as shown in FIG. 9.

At this time, the second stacker tray 112*b* waits at its home position. Furthermore, the first stacker tray 112*a* upstream of the second stacker tray 112*b* waits at approximately a midpoint between the sheet conveyance portion 132 and the home position (sheet surface position), i.e. at a position higher than the second stacker tray 112*b*. Consequently, a step height is made between the first stacker tray 112*a* and the second stacker tray 112*b*.

Figure 10:
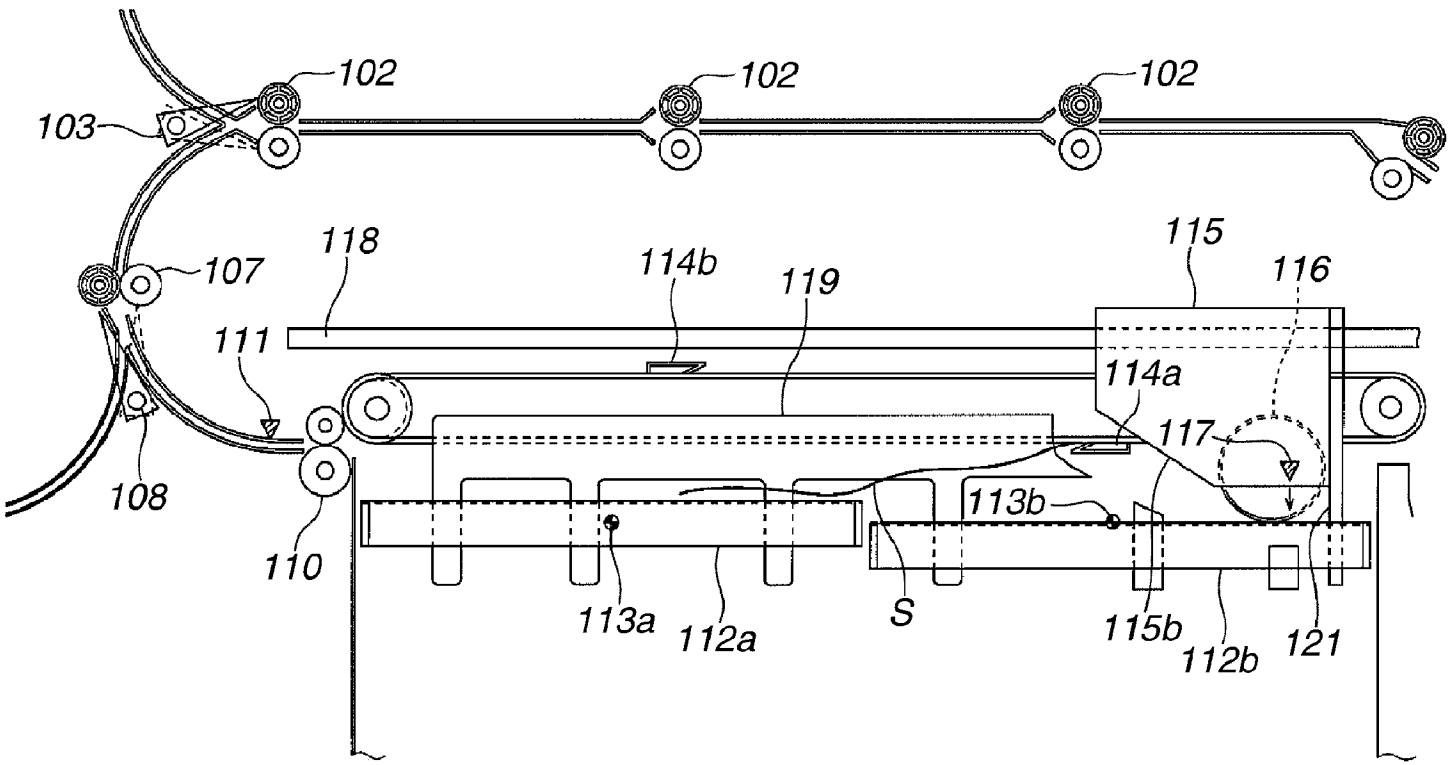
FIG. 10 is a second illustration for describing an operation of stacking a sheet when a total number of sheets to be stacked on the stacker is greater than the number of stackable sheets on the stacker tray according to an exemplary embodiment of the present invention.

In this state, the sheet S is conveyed from the image forming apparatus main body 901 by the gripper 114*a*. The sheet S is conveyed so as to pass over the first stacker tray 112*a* and stacked along the second stacker tray 112*b* as shown in FIG. 10.

When the gripper 114*a* passes by the taper portion 115*b* of the guiding unit 115, the gripper 114*a* is driven to release the sheet. The sheet S is conveyed while its leading edge is guided toward the second stacker tray by the taper portion 115*b*, and then lead to the knurled belt 116.

Figure 11:
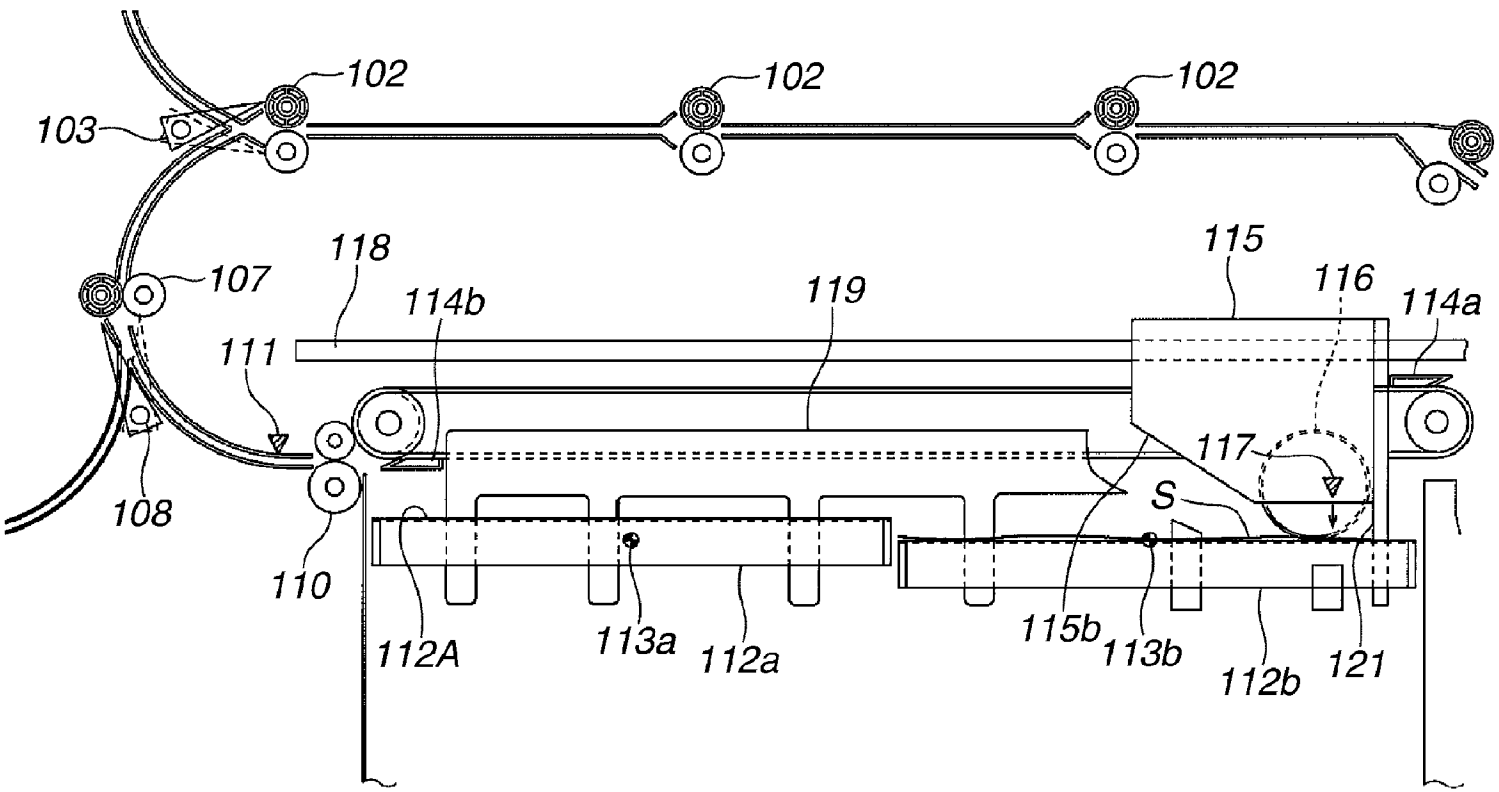
FIG. 11 is a third illustration for describing an operation of stacking a sheet when a total number of sheets to be stacked on the stacker is greater than the number of stackable sheets on the stacker tray according to an exemplary embodiment of the present invention.

The knurled belt 116 conveys the sheet S until the leading edge of the sheet abuts against the stopper 121 as shown in FIG. 11. Then, the sheet is stacked with its leading edge aligned on the second stacker tray 112*b*. After the sheets are stacked in this manner, the alignment plate 119 aligns the stacked sheets in the width direction.

A sheet stack side 112A of the first stacker tray 112*a* has a flat surface since it is not stacked, and retains positional accuracy in a vertical direction. Since the sheet stack side 112A serves as a guide of the sheet S conveyed to the stopper 121, the motion of the sheet is stable.

Further, as described above, the step height is made between the first stacker tray 112*a* which serves as a guide, and the second stacker tray 112*b*. With this step height, the sheet is conveyed smoothly to the second stacker tray 112*b* over the first stacker tray 112*a*.

The total number n of sheets which are to be stacked is greater than the number N of sheets which can be stacked on the first stacker tray 112*a* or second stacker tray 112*b*. Accordingly, when the above operation is repeated, the sheets in the second stacker tray 112*b* reach a predetermined stack height. The state that the sheets have reached a predetermined stack height is detected by the number of sheets conveyed from the discharge roller 110 or by a detection unit (not shown) configured to detect a height of the sheet stack mounted on the stacker tray 112.

Figure 12:
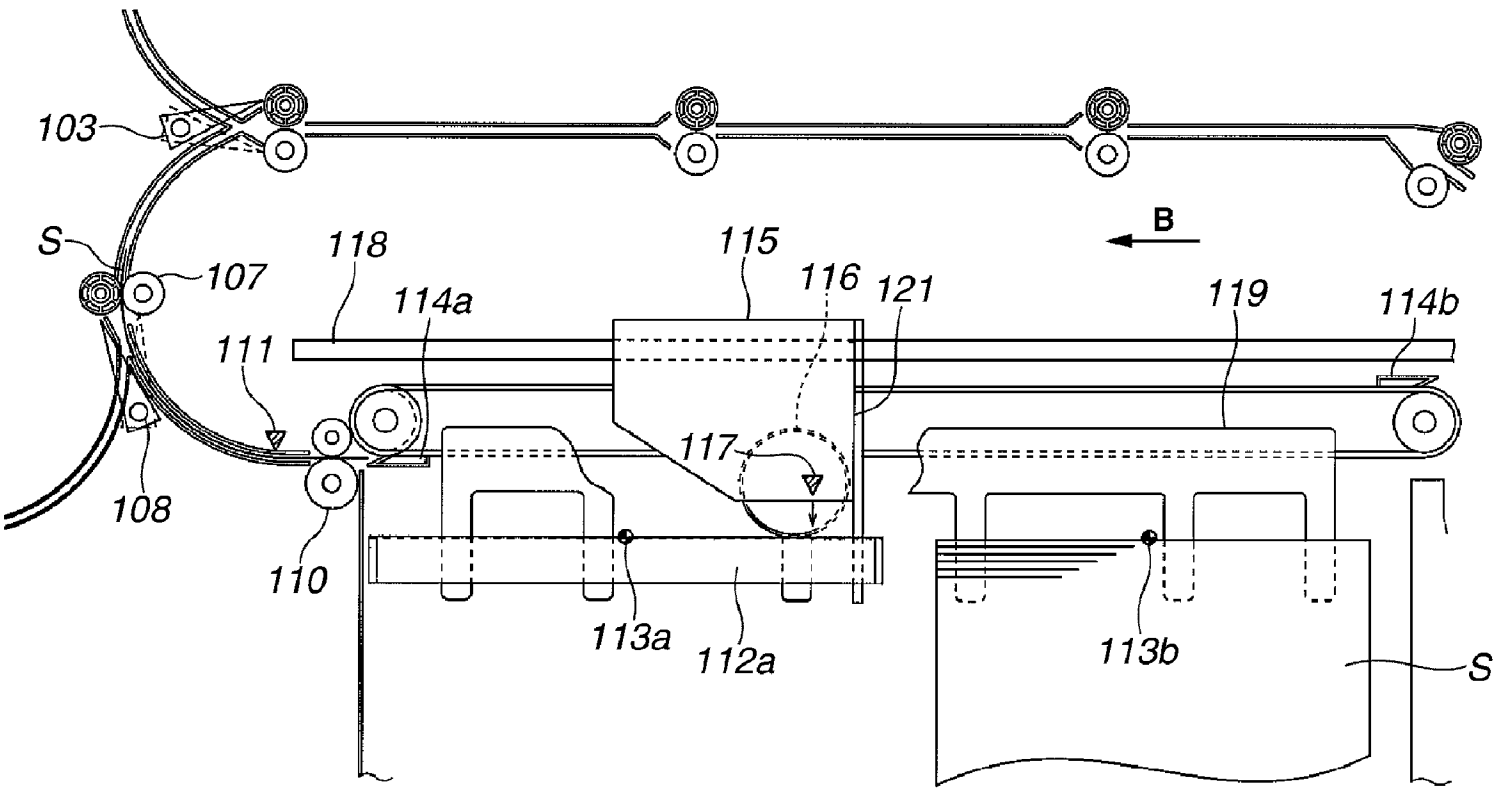
FIG. 12 is a fourth illustration for describing an operation of stacking a sheet when a total number of sheets to be stacked on the stacker is greater than the number of stackable sheets on the stacker tray according to an exemplary embodiment of the present invention.

When it is detected that the sheets stacked on the second stacker tray 112*b* have reached a predetermined stack height, the second stacker tray 112*b* is determined to be fully loaded. Then, the guiding unit 115 moves in the direction of the arrow B toward the first stacker tray 112*a* as shown in FIG. 12. Subsequently, the guiding unit 115 waits at a position where it can stack a sheet on the first stacker tray 112*a* until a sheet is conveyed.

At this time, the first stacker tray 112*a* moves from a position higher than the second stacker tray 112*b* to its home position. After that, a sheet S is stacked on the first stacker tray 112*a*. This stacking operation is the same as the above-described operation performed when the total number n of sheets which are to be stacked is smaller than the number N of sheets which can be stacked.

Figure 13:
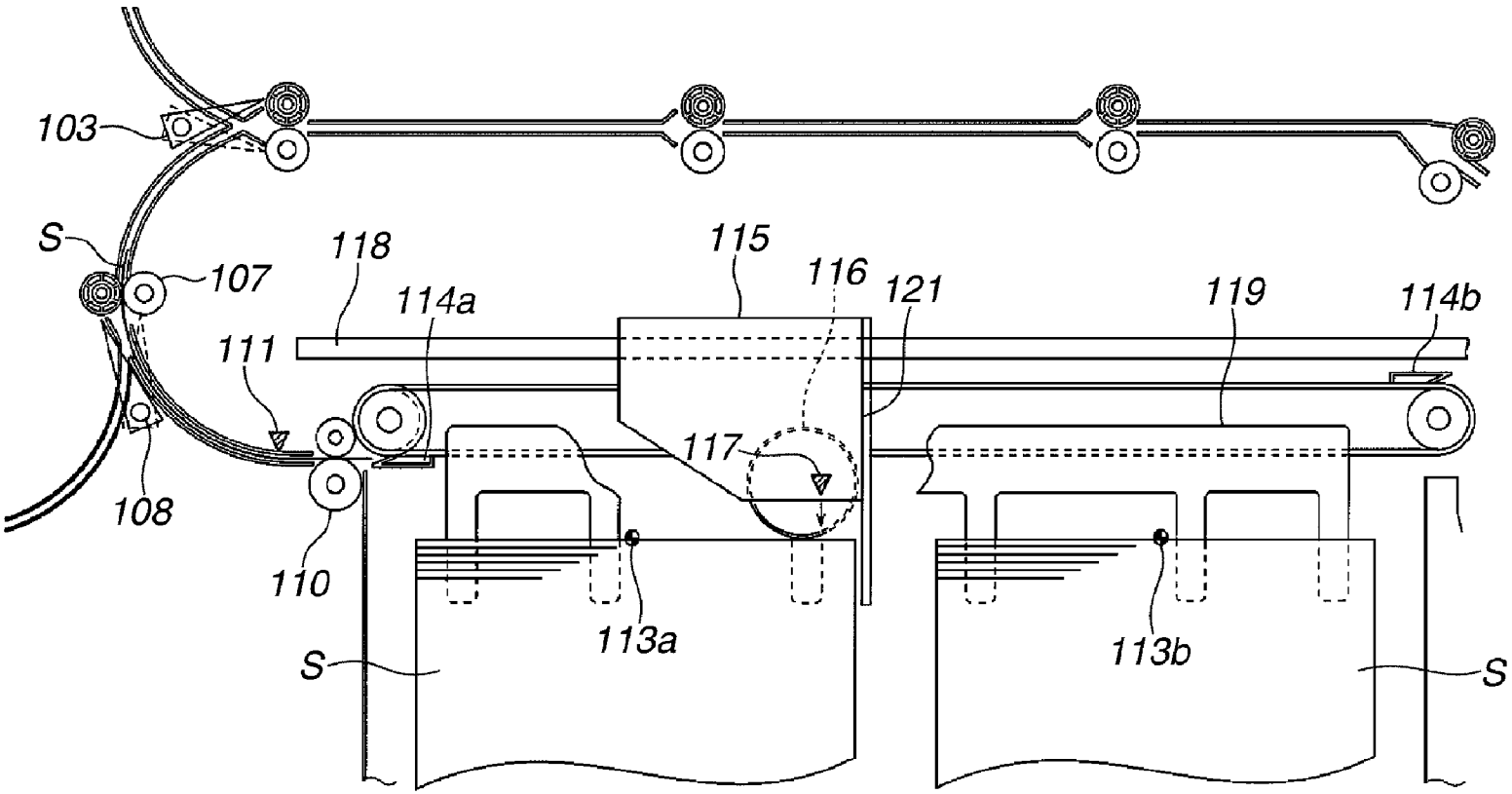
FIG. 13 is a fifth illustration for describing an operation of stacking a sheet when a total number of sheets to be stacked on the stacker is greater than the number of stackable sheets on the stacker tray according to an exemplary embodiment of the present invention.

In this way, sheets are stacked on the first stacker tray 112*a* as well as the second stacker tray 112*b* as shown in FIG. 13. More specifically, sheets are stacked on the second stacker tray 112*b* until the stacked sheets reach a predetermined stack height and then the rest of the sheets are stacked on the first stacker tray 112*a*.

On the other hand, if the total number n of sheets which are to be stacked is greater than a number 2N of sheets which can be stacked on the first stacker tray 112*a* and the second stacker tray 112*b*, if the stacking operation of the sheets continues, finally, the sheets are stacked also on the first stacker tray 112*a* to a predetermined stack height.

Figure 14:
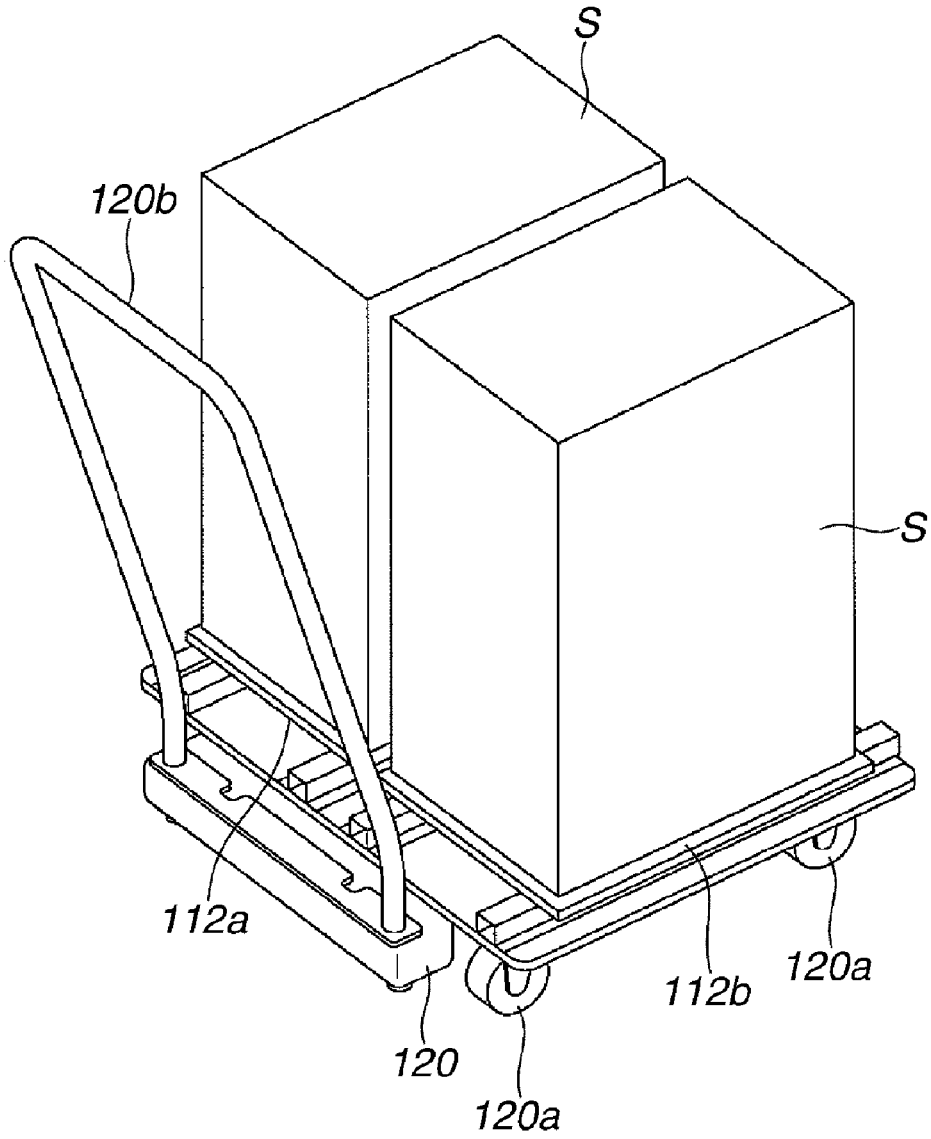
FIG. 14 is a perspective view of the first and the second stacker trays on a dolly according to an exemplary embodiment of the present invention where the stacker trays move down to be placed on the dolly when the sheets stacked on the stacker trays reach a predetermined stack height.

Thus, when the sheets are stacked to a predetermined stack height not only on the first stacker tray 112*b* but also on the second stacker tray 112*a*, the stacker control unit 210 determines that the trays are fully loaded and the first stacker tray 112*a* and the second stacker tray 112*b* move down. The first stacker tray 112*a* and the second stacker tray 112*b* are set on a dolly 120 with the sheets shown in FIG. 14. The first stacker tray 112*a* and the second stacker tray 112*b* are fixed to the dolly 120 with a fixing member such as a pin.

By taking out the dolly 120 in this state, the sheets loaded fully on the first stacker tray 112*a* and the second stacker tray 112*b* can be removed from the stacker 100. The dolly 120 has casters 120*a*. By holding the handle 120*b* and moving the dolly 120, the user can move a large number of sheets at a time.

After removing the sheets, the user sets the dolly 120, the first stacker tray 112*a*, and the second stacker tray 112*b* onto the stacker 100. Then, the first stacker tray 112*a* and the second stacker tray 112*b* are moved up by a driving device (not shown). In this way, the first stacker tray 112*a* and the second stacker tray 112*b* return to a state illustrated in FIG. 3, and stacking of a next sheet becomes possible.

In the above described case, half size sheets (for example, A4 size) can be stacked on either the first stacker tray 112*a* or the second stacker tray 112*b*. Next, a case will be described where a large size sheet (for example, A3 size) whose length in the conveying direction exceeds the length of the first stacker tray 112*a* or the second stacker tray 112*b* is stacked.

Figure 15:
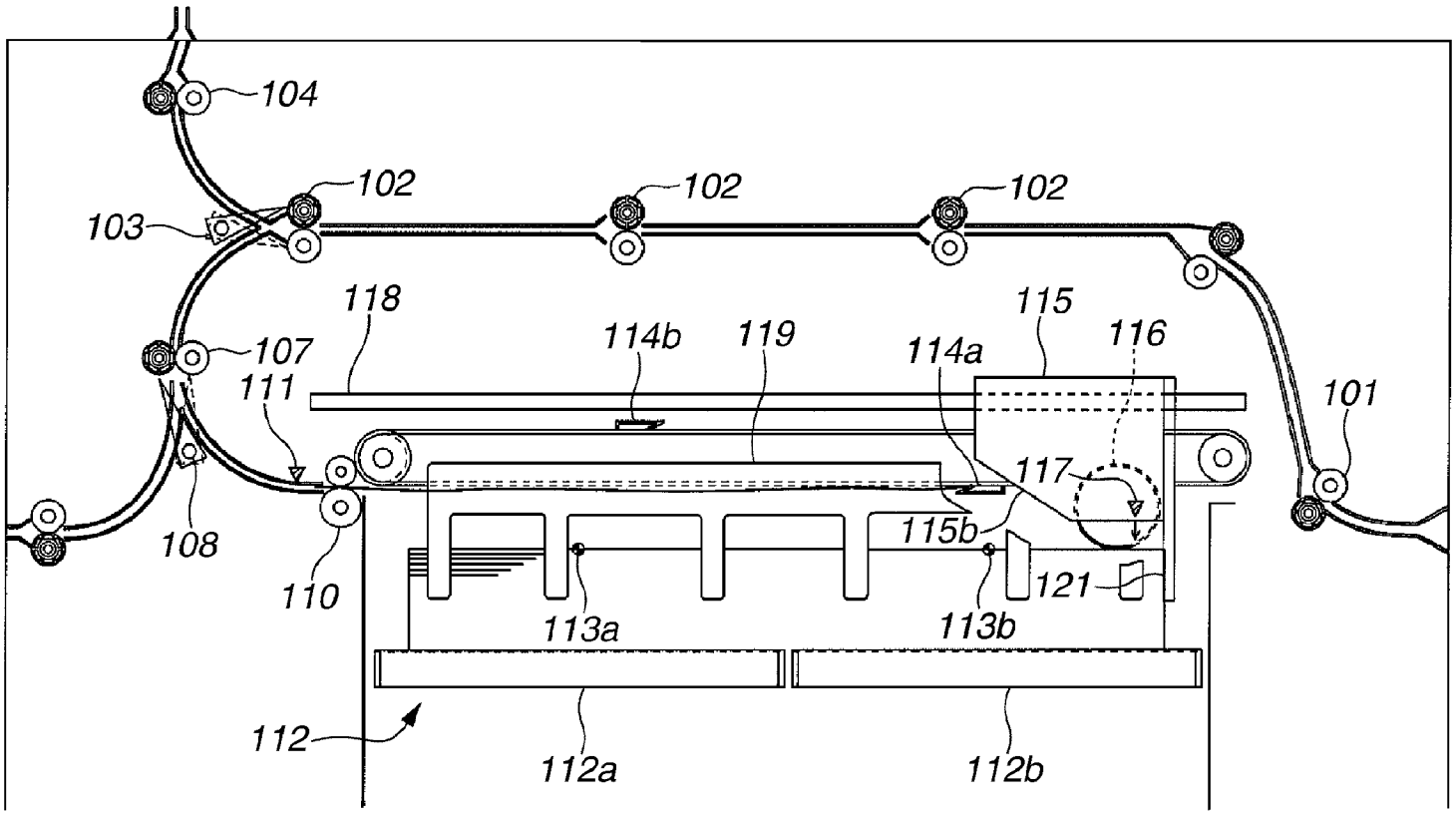
FIG. 15 illustrates a sheet stacking operation when a large size sheet is stacked across the first and the second stacker trays according to an exemplary embodiment of the present invention.

In a case where a large size sheet is stacked, the guiding unit 115 waits at a downstream side of the second stacker tray 112*b* in a sheet conveying direction as shown in FIG. 15. When the sheet S is pinched and conveyed from the image forming apparatus main body 901 by the gripper 114*a* as described above, the sheet S is conveyed over the first stacker tray 112*a* and along the second stacker tray 112*b*.

When the gripper 114*a* passes by the taper portion 115*b* of the guiding unit 115, the gripper 114*a* is driven to release the sheet. The sheet S is conveyed while its leading edge is guided by the taper portion 115*b* toward the second stacker tray 112*b* and then led to the knurled belt 116.

The sheet S is conveyed by the knurled belt 116 until its leading edge abuts against the stopper 121. In this manner, the sheet is stacked across the first stacker tray 112*a* and the second stacker tray 112*b* with its leading edge aligned. After the sheet S is stacked in this manner, the alignment plate 119 aligns the stack of sheets in the width direction.

When a large-size sheet is stacked, the top surface of the sheet stack stacked across the first stacker tray 112*a* and the second stacker tray 112*b* is monitored continuously by a plurality of sensors such as the sheet surface detection sensor 117 and the home position sensors 113*a* and 113*b*.

By the sheet surface detection sensor 117 and the home position sensors 113*a* and 113*b*, the first stacker tray 112*a* and the second stacker tray 112*b* are moved down over a same distance at the same timing by a driving device (not shown) so that the top surface of the sheet stack remains level. After the stacker trays have been moved down, the operation of stacking the sheet S will be started again.

Figure 16:
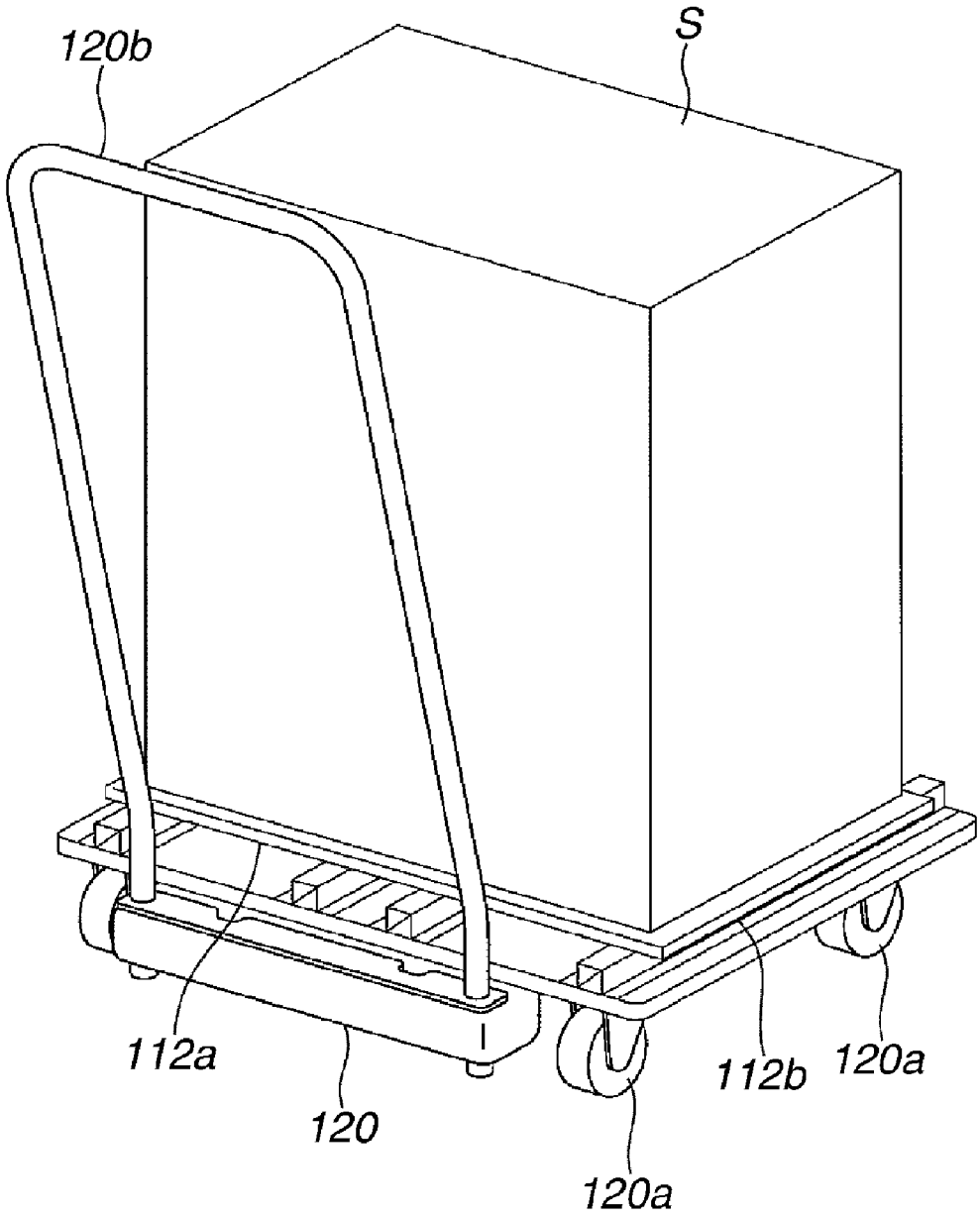
FIG. 16 is a perspective view of the first and the second stacker trays when the stacker trays reach a predetermined stack height and move down to be placed on the dolly. Large size sheets are stacked across the first and the second stacker trays.

When the sheets stacked across the first stacker tray 112*a* and the second stacker tray 112*b* reach a predetermined stack height and the trays are fully loaded, the first stacker tray 112*a* and the second stacker tray 112*b* are moved down onto the dolly 120 as shown in FIG. 16. Then, the dolly 120 is removed by the user from the stacker 100.

Figure 17:
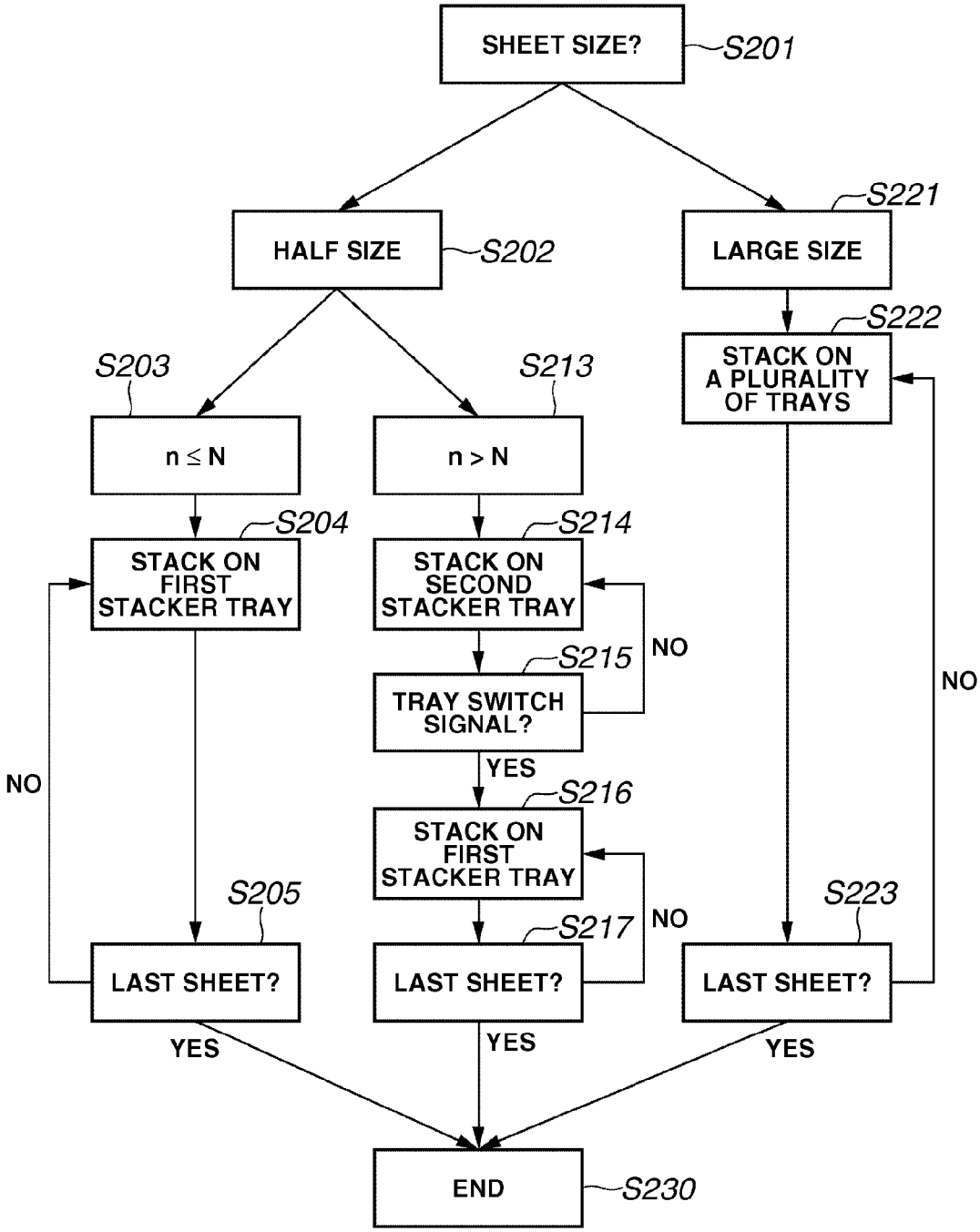
FIG. 17 is a flowchart describing a control of the above described stacker to change trays and a number of trays depending on sheet size according to an exemplary embodiment of the present invention.
Figure 18:
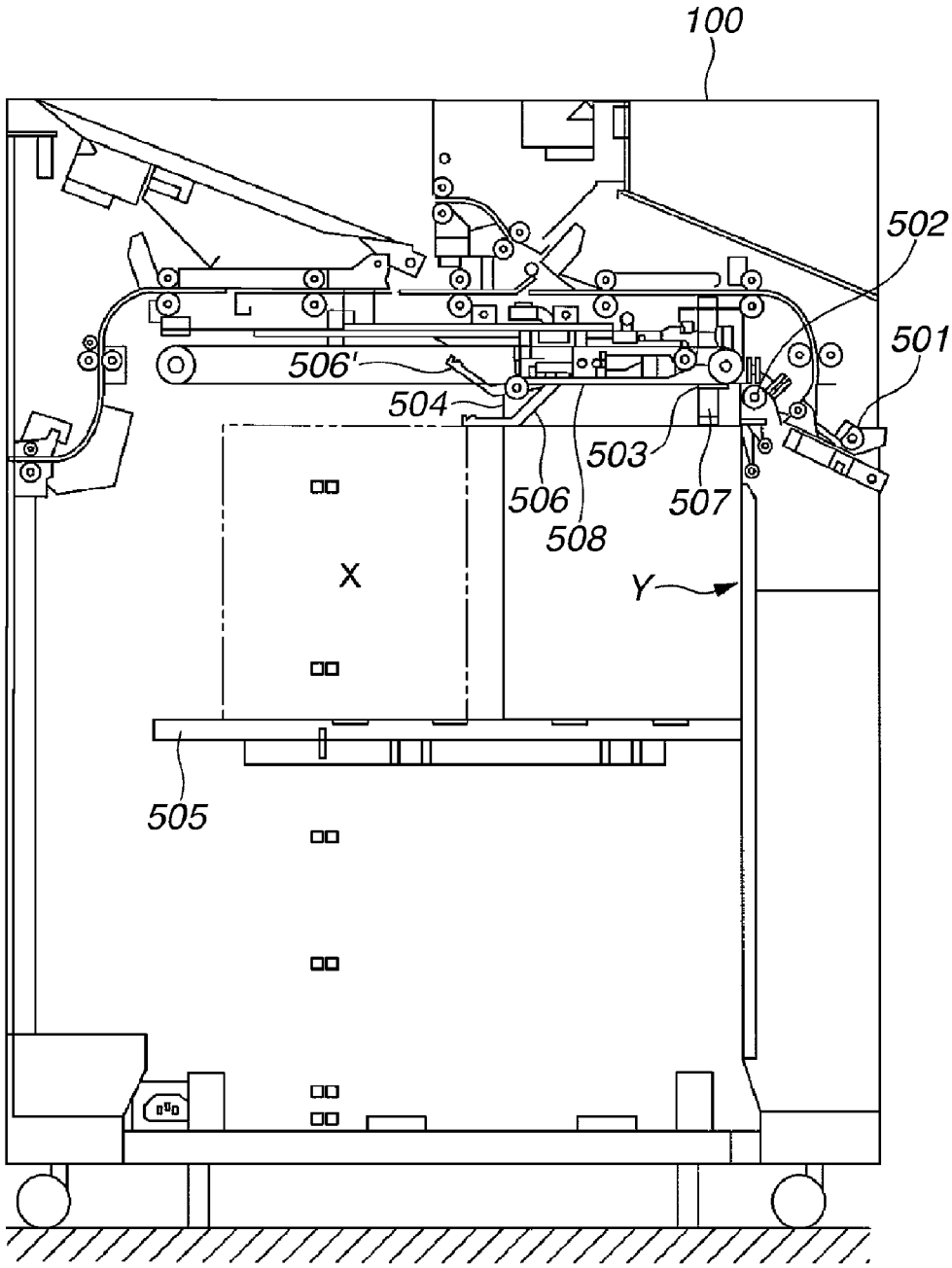
FIG. 18 illustrates a configuration of a conventional sheet stacking apparatus which is capable of processing a large number of sheets.

FIG. 17 is a flowchart describing the control of the stacker control unit 210 when it changes the trays and the number of trays according to the length of the sheet in the conveying direction.

According to the present exemplary embodiment, the stacker control unit 210 serving as a controller determines the length of the sheet in the sheet conveying direction based on sheet information (sheet size information) sent from the CPU circuit unit 206 (step S201). If the sheet is half size which is stackable in the first stacker tray 112*a* or the second stacker tray 112*b*, according to calculation information sent from the CPU circuit unit 206, the stacker control unit 210 compares a total number n of sheets which are to be stacked and a number N of sheets which can be stacked (step S202).

If the total number n of sheets which are to be stacked is equal to or smaller than the number N of sheets which can be stacked ($n \leqq N$) (step S203), sheets will be stacked on the first stacker tray 112*a* which is closer to the discharge roller 110 (step S204). This operation is repeated until the last sheet is stacked (step S205). When the last sheet is stacked, the operation ends (step S230).

If the total number n of sheets which are to be stacked is greater than the number N of sheets which can be stacked ($n>N$) (step S213), sheets will be stacked on the second stacker tray 112*b* (step S214) until a tray switch signal is output (step S215).

If the tray switch signal is input which is a detection signal sent from a detection portion that detects whether the sheets have reached a predetermined stack height, the stacker tray is switched and then sheets will be stacked on the first stacker tray 112*a* (step S216). This operation is performed until the last sheet is stacked (step S217). When the last sheet is stacked, the operation ends (step S230).

On the other hand, if the sheet is large so that the sheet is stacked across a plurality of stacker trays (step S221), the sheet is stacked across the first stacker tray 112*a* and the second stacker tray 112*b* (step S222). This operation is performed until the last sheet is stacked (step S223). When the last sheet is stacked, the operation ends (step S230).

According to the present exemplary embodiment, the sheet stacking portion 112 includes the first stacker tray 112*a* and the second stacker tray 112*b* which move up and down separately. If the number of sheets to be stacked exceeds the number of sheets which can be stacked on one stacker tray, after the sheets are stacked on one stacker tray at a downstream side in a sheet conveying direction, the sheets will be stacked on another stacker tray at an upstream side in the sheet conveying direction. As a result, the alignment of the sheets stacked on the first stacker tray 112*a* at a upstream side in the sheet conveying direction is not disturbed. Also, a large number of sheets can be stacked on the sheet stacking portion 112.

Further, by selecting the first stacker tray 112*a* or the second stacker tray 112*b* according to the number of sheets to be stacked and the length of the sheet in the sheet conveying direction, twice as many sheets can be stacked on the sheet stacking portion 112 compared to the case where one stacker tray is used.

According to the description above, switching from the second stacker tray 112*b* to the first stacker tray 112*a* is performed based on detection by a detection device (not shown) that the second stacker tray 112*b* has reached a predetermined stack height. However, the present invention is not limited to such a case. For example, the stacker 100 can include a counting portion 220 which counts the number of sheets to be stacked onto the sheet stacking portion 122. Based on the count result, the stacker control unit 210 controls the stacker trays so that when approximately half the number n of total sheets which are to be stacked is stacked on the second stacker tray 112*b*, the second stacker tray 112*b* can be switched to the first stacker tray 112*a*.

In such a case, approximately the same number of sheets will be stacked on the first stacker tray 112*a* and the second stacker tray 112*b*. As a result, the height of the sheet stack can be lowered as a whole, which helps provide stability to the sheets when they are removed by the dolly 120.

Further, in the description above, the first stacker tray 112*a* when the sheet is being conveyed to the second stacker tray 112*b* is approximately at the midpoint of the discharge roller 110 and the top surface of the sheet stack on the second stacker tray 112*b*. This position of the first stacker tray 112*a*, however, is not limited to the midpoint as long as a sheet can be stacked without problems.

Further, in the above descriptions, two stacker trays 112*a* and 112*b* are used, however a similar effect can be obtained when three or more stacker trays are used. Furthermore, in the above descriptions, the CPU circuit unit 206 controls the sheet stacking operation through the stacker control unit 210, however, the CPU circuit unit 206 can directly control the sheet stacking operation.

According to the exemplary embodiment of the present invention, the grippers 114*a* and 114*b* in the sheet conveyance portion 132 pinch and convey the sheet. However, the present invention is not limited to such a device. For example, an air suction device or an electrostatic attracting device can also be used so long as it conveys a sheet while holding the leading edge of the sheet.

Furthermore, although it is not described above, the number of sheets which can be stacked on the first stacker tray 112*a* and the second stacker tray 112*b* can be the same or different.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A sheet stacking apparatus, comprising:

a conveyance portion configured to convey a sheet, including a holding portion configured to move in a sheet conveying direction while holding a downstream end of the sheet in the sheet conveying direction;

a first sheet stacking portion, having a first stacking surface which moves down depending on increase of stacked sheets thereon, configured to stack a sheet conveyed by the conveyance portion;

a second sheet stacking portion, having a second stacking surface which moves down depending on increase of stacked sheets thereon, configured to stack a sheet conveyed by the conveyance portion, and to be arranged downstream of the first sheet stacking portion in the sheet conveying direction of the conveyance portion; and a controller configured to determine one of the first and second sheet stacking portions as a destination of the sheet, based on sheet information of the sheet to be stacked, the controller controlling movement of the holding portion so that the holding portion firstly conveys, to the second sheet stacking portion, a sheet to be stacked, and then conveys, to the first sheet stacking portion, a sheet to be stacked, when a total number of sheets to be stacked for a given job, as the sheet information, exceeds a number of sheets which can be stacked on one of the first and second sheet stacking portions, wherein when the sheet to be stacked on the second sheet stacking portion passes over the first sheet stacking portion, an upstream end of the sheet in the sheet conveying direction is guided along stacking surface, on which a sheet is not stacked, of the first sheet stacking portion while the downstream end of the sheet is held by the holding portion.

2. A sheet stacking apparatus according to claim 1, wherein when the conveyance portion conveys a sheet to the first and second sheet stacking portions, a remainder of the sheets to be stacked is stacked on the first sheet stacking potion after a predetermined number of sheets out of the total number of sheets to be stacked are stacked on the second sheet stacking potion.

3. A sheet stacking apparatus according to claim 1, further comprising:

a detection portion configured to detect a height of the sheets stacked on the second sheet stacking portion, wherein the controller is configured to change a sheet stacking portion on which sheets are stacked from the second sheet stacking portion to the first sheet stacking portion based on a detection result that the height of the stacked sheets reached a predetermined height.

4. A sheet stacking apparatus according to claim 1, further comprising:

a counting portion configured to determine, as sheet information, a stack number by counting the sheets that are stacked on the second sheet stacking portion, wherein the controller is configured to change a sheet stacking portion on which sheets are stacked from the second sheet stacking portion to the first sheet stacking portion based on the sheet information indicating that the stack number reached a predetermined number.

5. A sheet stacking apparatus according to claim 4, wherein the controller is configured to change the sheet stacking portion on which sheets are stacked from the second sheet stacking portion to the first sheet stacking portion when the stack number reaches approximately one-half the total number of the sheets to be stacked.

6. A sheet stacking apparatus according to claim 1, wherein when the conveyance portion conveys a sheet onto the second sheet stacking portion, the first stacking surface of the first sheet stacking portion is positioned below the conveyance portion and above the second stacking surface of the second sheet stacking portion.

7. A sheet stacking apparatus according to claim 1, wherein a single open area resides below the conveyance portion and above both the first sheet stacking portion and the second sheet stacking portion.

8. A sheet stacking apparatus according to claim 1, wherein the first sheet stacking portion and the second sheet stacking portion each are configured to be lowered onto a single moveable support.

9. A sheet stacking apparatus according to claim 1, further comprising:

a discharge roller configured to convey the downstream end of a sheet from the discharge roller directly to the holding portion, wherein a position of a top surface of sheets stack on the first stacking surface of the first sheet stacking portion is set below the discharge roller so that, even when a top sheet positioned on a top of the sheets stack on the stacking surface of the first sheet stacking portion has an upward curl, a leading edge of a next sheet does not stick in the discharge roller.

10. An image forming apparatus, comprising:

an image forming unit configured to form an image on a sheet; and a sheet stacking apparatus, configured to stack an image-formed sheet, according to claim 1.

11. An image forming apparatus, comprising:

an image forming unit configured to form an image on a sheet;

a sheet stacking apparatus, configured to stack an image-formed sheet; and a controller configured to control the sheet stacking apparatus based on sheet information of the sheet to be stacked, wherein the sheet stacking apparatus includes:

a conveyance portion configured to convey a sheet, including a holding portion configured to move in a sheet conveying direction while holding a downstream end of the sheet in the sheet conveying direction, a first sheet stacking portion, having a first stacking surface which moves down depending on increase of stacked sheets thereon, configured to stack a sheet conveyed by the conveyance portion, and a second sheet stacking portion, having a second stacking surface which moves down depending on increase of stacked sheets thereon, configured to stack a sheet conveyed by the conveyance portion, and to be arranged downstream of the first sheet stacking portion in the sheet conveying direction of the conveyance portion, wherein the controller controls movement of the holding portion so that the holding portion firstly conveys, to the second sheet stacking portion, a sheet to be stacked, and then conveys, to the first sheet stacking portion, a sheet to be stacked, when a total number of sheets to be stacked for a given job, as the sheet information, exceeds a number of sheets which can be stacked on one of the first and second sheet stacking portions, and wherein when the sheet to be stacked on the second sheet stacking portion passes over the first sheet stacking portion, an upstream end of the sheet in the sheet conveying direction is guided along the first stacking surface, on which a sheet is not stacked, of the first sheet stacking portion while the downstream end of the sheet is held by the holding portion.

12. An image forming apparatus according to claim 11, wherein when the conveyance portion conveys a sheet to the first and second sheet stacking portions, a remainder of the sheets to be stacked is stacked on the first sheet stacking potion after a predetermined number of sheets out of the total number of sheets to be stacked are stacked on the second sheet stacking potion.

13. An image forming apparatus according to claim 11, wherein the sheet stacking apparatus further includes:

a detection portion configured to detect a height of the sheets stacked on the second sheet stacking portion, wherein the controller is configured to change a sheet stacking portion on which sheets are stacked from the second sheet stacking portion to the first sheet stacking portion based on a detection result that the height of the stacked sheets reached a predetermined height.

14. An image forming apparatus according to claim 11, further comprising:

a counting portion configured to determine, as sheet information, a stack number by counting the sheets that are stacked on the second sheet stacking portion, wherein the controller is configured to change a sheet stacking portion on which sheets are stacked from the second sheet stacking portion to the first sheet stacking portion based on the sheet information indicating that the stack number reached a predetermined number.

15. An image forming apparatus according to claim 14, wherein the controller is configured to change the sheet stacking portion on which sheets are stacked from the second sheet stacking portion to the first sheet stacking portion when the stack number reaches approximately one-half the total number of the sheets to be stacked.

16. An image forming apparatus according to claim 11, wherein when the conveyance portion conveys a sheet onto the second sheet stacking portion, the first stacking surface of the first sheet stacking portion is positioned below the conveyance portion and above the second stacking surface of the second sheet stacking portion.

17. An image forming apparatus according to claim 11, wherein a single open area resides below the conveyance portion and above both the first sheet stacking portion and the second sheet stacking portion.

18. An image forming apparatus according to claim 11, wherein the first sheet stacking portion and the second sheet stacking portion each are configured to be lowered onto a single moveable support.

19. An image forming apparatus according to claim 11, further comprising:

a discharge roller configured to convey the downstream end of a sheet from the discharge roller directly to the holding portion, wherein a position of a top surface of sheets stack on the stacking surface of the first sheet stacking portion is set below the discharge roller so that, even when a top sheet positioned on a top of the sheets stack on the first stacking surface of the first sheet stacking portion has an upward curl, a leading edge of a next sheet does not stick in the discharge roller.

* * * * *